US006363739B1

(12) United States Patent
Hodosh et al.

(10) Patent No.: US 6,363,739 B1
(45) Date of Patent: Apr. 2, 2002

(54) INSULATED CONTAINER AND RECEPTACLE THEREFOR

(75) Inventors: Marc A. Hodosh, Brookline, MA (US); Melvin S. Mogil; Kenneth L. Bousfield, both of Toronto (CA)

(73) Assignee: California Innovations, Inc., Toronto (CA)

( * ) Notice: Subject to any disclaimer, the term of this patent is extended or adjusted under 35 U.S.C. 154(b) by 0 days.

(21) Appl. No.: 09/629,284

(22) Filed: Jul. 31, 2000

Related U.S. Application Data

(60) Division of application No. 09/264,541, filed on Mar. 8, 1999, now Pat. No. 6,116,045, which is a continuation-in-part of application No. 09/036,566, filed on Mar. 9, 1998, now Pat. No. 5,924,303.

(51) Int. Cl.[7] ..... F25D 3/08
(52) U.S. Cl. ..... 62/457.4; 62/457.5; 62/457.7
(58) Field of Search ..... 62/457.4, 457.7, 62/457.5; 220/592.17, 592.16; 206/549, 541, 545

(56) References Cited

U.S. PATENT DOCUMENTS

| | | | | | |
|---|---|---|---|---|---|
| 2,555,788 | A | * | 6/1951 | Donaldson | 206/4 |
| 2,610,472 | A | * | 9/1952 | Maxwell | 62/2 |
| 2,645,332 | A | * | 7/1953 | Martin et al. | 206/4 |
| 3,255,607 | A | * | 6/1966 | Bair et al. | 62/372 |
| 3,572,054 | A | * | 3/1971 | Curcio | 62/390 |
| 3,998,072 | A | * | 12/1976 | Shaw | 62/457 |
| 4,050,264 | A | * | 9/1977 | Tanaka | 62/457 |
| 4,286,440 | A | * | 9/1981 | Taylor | 62/457 |
| 4,499,998 | A | * | 2/1985 | Carlson | 206/541 |
| 4,551,988 | A | * | 11/1985 | Petrantoni | 62/457 |
| 4,610,286 | A | * | 9/1986 | Cyr | 150/52 |
| 4,655,052 | A | | 4/1987 | Garcia | |
| 4,673,117 | A | | 6/1987 | Calton | |
| 4,706,856 | A | | 11/1987 | Jacober | |
| 4,819,793 | A | | 4/1989 | Willard | |
| 4,858,444 | A | | 8/1989 | Scott | |
| 4,916,923 | A | | 4/1990 | Adams et al. | |
| 4,923,060 | A | | 5/1990 | Breslau | |
| 4,941,603 | A | | 7/1990 | Creamer et al. | |
| 4,984,662 | A | | 1/1991 | Jacober | |
| 5,050,399 | A | | 9/1991 | Peahl | |
| 5,095,718 | A | | 3/1992 | Ormond et al. | |
| D328,550 | S | | 8/1992 | Mogil | |
| 5,313,807 | A | | 5/1994 | Owen | |
| 5,354,131 | A | | 10/1994 | Mogil | |
| 5,400,610 | A | | 3/1995 | Macedo | |
| 5,501,338 | A | | 3/1996 | Preston | |
| 5,505,307 | A | * | 4/1996 | Shink | 206/541 |
| D382,771 | S | | 8/1997 | Mogil | |
| D382,772 | S | | 8/1997 | Mogil | |
| D387,249 | S | | 12/1997 | Mogil | |
| D389,704 | S | | 1/1998 | Yousko et al. | |
| 5,718,124 | A | | 2/1998 | Senecal | |
| 5,842,571 | A | * | 12/1998 | Rausch | 206/549 |
| D408,225 | S | | 4/1999 | Hodosh | |
| 5,924,303 | A | * | 7/1999 | Hodosh | 62/457.4 |
| 6,087,816 | A | | 5/2000 | Hodosh | |
| 6,116,045 | A | | 9/2000 | Hodosh et al. | |

FOREIGN PATENT DOCUMENTS

| | | |
|---|---|---|
| GB | 2 025 593 | 1/1980 |

* cited by examiner

*Primary Examiner*—Henry Bennett
*Assistant Examiner*—Chen-Wen Jiang
(74) *Attorney, Agent, or Firm*—Cook, Alex, McFarron, Manzo, Cummings & Mehler, Ltd.

(57) ABSTRACT

An insulated container has a container wall, and a space to be warmed or cooled defined within the container wall. The container has an opening in the wall and a receptacle positioned so that objects introduced through the opening can seat in the receptacle and extend outwardly through the opening so that part of the object, such as a canned or bottled drink, seats within the receptacle, and part extends outwardly of the container so that a user can reach it. Either or both of the receptacle and the container can be collapsible.

18 Claims, 28 Drawing Sheets

INSULATED CONTAINER AND RECEPTACLE THEREFOR

This application is a divisional of U.S. patent application Ser. No. 09/264,541 filed Mar. 3, 1999 (Now U.S. Pat. No. 6,116,045), which is a continuation-in-part to application Ser. No. 09/036,566 filed Mar. 9, 1998 now U.S. Pat. No. 5,924,303.

FIELD OF THE INVENTION

The invention pertains to insulated containers. More specifically it relates to insulated containers having externally accessible receptacles for holding objects such as, for example, beverage or foodstuff containers.

BACKGROUND OF THE INVENTION

Portable insulated cases can be used for temporarily storing containerized drinks or foods, or other products that may benefit from a cooled or warmed environment, such as some medicinal products, film, or other temperature sensitive materials. Insulated containers that are easily transportable are known and can be used for a variety of purposes. Included are containers which are designed for temporary storage of food, drink or other products for use in connection with personal travel, day trips, outings, and other similar activities where, for example a drink or meal supply, or other good, needs to be kept cool or warm for some period of time, typically several hours.

Cases or containers in this regard include soft-walled coolers. Notably, although commonly and conveniently referred to as coolers, many insulated "coolers" are also suited for maintaining the warmth of diverse objects, within a reasonable temperature range such as may be suitable, for example, for human handling. In a typical cooling application, an insulated enclosure, container, or casing, is provided with a low temperature thermal storage medium, such as by ice cubes or so-called ice bricks positioned within the cooler to assist in maintaining a lower temperature within the cooler than is typically present outside of the cooler. The cooler is exposed to outside or ambient temperatures such as room temperature, or some higher temperature environment, such as may be encountered during summer months, for example. Typically, these types of coolers function solely as a vehicle for storage of drink and food products within the enclosure volume provided within the walls of the cooler. Once the item to be consumed is removed from the inside volume of the cooler, the cooler ceases to have any designed function in connection with the items to be consumed. For example, once the item to be consumed is removed from the container, it is no longer influenced by the cooling function provided by the cooler.

An advantage can be gained by creating a situation in which, a cooler can continue to provide the opportunity for positive interaction between the cooler and food, beverage or other item such as a containerized drink after it has been removed from the cooler. To that end, it would be advantageous to have an insulated container, whether for cooling or warming, that permits a user to remove an item to be consumed, such as a cold drink, to open that object and to consume some of it. However, when only a portion of the object has been consumed, it would be advantageous to have a place, such as a beverage container receptacle, where the partially consumed object may be placed pending further depletion of its contents. Further still, rather than have the object to be consumed either warm up or cool down from its desired temperature, it would be advantageous to be able to delay, or prevent, or reduce the rate of, heat gain or heat loss from the initial temperature.

A container having an externally accessible receptacle for holding a beverage container once it has been opened may have one or more of the desired advantages noted above. However, beverages such as might be seated in the externally accessible receptacle may tend to spill. Carbonated soda beverages, juices, hot chocolate, coffee, or tea, once spilled, may dry and leave a sticky or gummy residue. It may not be desirable for spillage to enter the main body of the enclosure, and hence a leak catching, or water tight receptacle may tend to be preferred. Also, since the receptacle may not always be in use, and whether or not one carries beverages or other objects are carried in the main body of an insulated container or enclosure, there may be occasions when it would be advantageous to use the space usually occupied by the receptacle for carrying objects internally. To that end, it would be advantageous to employ a receptacle that can be collapsed, folded, deflected, or otherwise placed in a relatively less obtrusive position, such as a storage position, than when occupied by, for example, a beverage container.

While it is helpful of itself to deter spills from entering the main body of the container, once the receptacle itself has accumulated a number of such spills, and those spills have dried, in whole or in part, it would be helpful to be able to remove the receptacle for washing. It would also be advantageous to be able to replace a punctured or otherwise damaged receptacle with a replacement part, or to replace a receptacle of one size with a receptacle of a different size or shape. For example, a receptacle for receiving a rectangular container, such as a drinking box, may be replaced with a round receptacle for a bottle or a canned drink.

For the purposes of cooling, or heating an object, such as a beverage, located in a receptacle, it would be advantageous under some conditions for the heat or cold source to be in close contact with the receptacle, thereby shortening the heat transfer path. It may also be advantageous, in the case of cooling, to have a cold source suspended within the larger enclosure, rather than sitting on the bottom panel.

When an externally accessible receptacle is not in use, it may be advantageous to provide a covering to deter unwanted objects from entering the receptacle, and also to discourage undesired heat transfer between the external ambient and the internal enclosed space of the container through the receptacle. It may also be advantageous to provide an external cover, or shield, to shade or shroud that portion of an object that may protrude from the externally accessible receptacle. It may further be advantageous to provide either more than one size of receptacle, or a receptacle that can accommodate more than one size of object.

SUMMARY OF THE INVENTION

An insulated soft-sided portable case having one or more externally accessible receptacles is provided. A plurality of panels define an insulated enclosure which retards heat transfer and which is adapted to receive cold drinks and foods and cooling sources such as ice cubes, cooling bricks, and the like. A top panel of the portable insulated container has at least one, opening therethrough, and a receptacle is positioned with respect to the opening so that the receptacle is accessible from the outside of the portable insulated case; that is, the user can place an item such as a containerized cold drink within the receptacle without having to open the portable insulated case. This externally accessible receptacle is thus adapted to function as a holder for the containerized drink and the like. It also projects well into the enclosed volume of the container. As such, the portable insulated case functions as a convenient and secure location for holding an opened drink without spilling it, while at the same time keeping a cold containerized drink cool.

In another aspect of the invention there is a collapsible insulated container. The container is moveable to an expanded position in which the container has an insulated space defined therewithin. The container has a container wall, an opening defined in the wall, and a receptacle mounted to extend inwardly of the wall into a portion of the insulated space. The receptacle is located to permit an object seated therein to protrude outwardly of the container through the opening. The container has a closure that is openable to give access to another portion of the insulated space.

In an additional feature of that aspect of the invention, the container is collapsible to a storage position, and the receptacle is collapsible within the container in the storage position. In a further additional feature to that additional feature, the container is a portable, soft-sided container having a top panel. The opening is defined in the top panel. In the expanded position the receptacle is mounted to, and depends from, the top panel; and, the receptacle is water tight. In a still further additional feature of that aspect of the invention, the receptacle is at least partially removable from the top panel and is washable. And, in a still further additional feature of that aspect of the invention, the container has a member for covering the opening when the receptacle is empty.

In another aspect of the invention, there is an insulated container having a container wall and an insulated space defined therewithin. The wall has an opening defined therein. A receptacle is mounted to extend inwardly of the wall into the space, the receptacle being positioned to permit an object seated therein to protrude through the opening outwardly of the container. The receptacle, when empty, is moveable to an out-of-use position.

In an additional feature of that aspect of the invention the receptacle is at least partially collapsible, and in the out-of-use position, the receptacle is in an at least partially collapsed condition. In another additional feature of that aspect of the invention, at least a portion of the receptacle is capable of movement to a deflected position, and, in the out of use position, the portion of the receptacle is in the deflected position. In another additional feature of that aspect of the invention, the receptacle has, in use, a cylindrical sidewall extending inwardly of the wall of the container, and the sidewall is resilient. In yet another additional feature of that aspect of the invention, the receptacle has, in use, a cylindrical sidewall extending inwardly of the wall of the container, and the sidewall is formed from a pliable membrane.

In a still further additional feature of that aspect of the invention, the receptacle has a means for urging objects introduced into the receptacle to a centered position. In a further additional feature of that additional feature, the receptacle has a cylindrical sidewall extending inwardly of the wall of the container, the sidewall having a distal end relative to the wall of the container, and means includes a base member of the receptacle mounted at the distal end of the sidewall, the base member having a concentrically contoured seat. In an alternative additional feature of that additional feature, the receptacle has a cylindrical sidewall extending inwardly of the wall of the container, and the means includes a resilient member mounted in a position to intercept objects as they are introduced into the receptacle, and the resilient member is positioned to exert a radially centering force on the objects. In an additional feature of that alternative additional feature, the resilient member is a resilient circumferential band mounted about the sidewall. In a further alternative additional feature of that additional feature, the container includes at least three resilient fingers mounted to obstruct objects introduced into the receptacle; each of the fingers is movable to a deflected position by an object introduced into the receptacle, and, in the deflected position, each of the fingers exerts a radially inward force on the object to urge it to a radially centered position relative to the cylindrical sidewall.

In another alternative feature of that additional feature of that aspect of the invention, the receptacle has a resilient sidewall extending inwardly of the wall of the container. The sidewall is capable of deflection when contacted by an object introduced into the receptacle. When deflected by the object, the sidewall being capable of exerting a force radially inward relative to the receptacle. In an additional feature of that additional feature, the sidewall includes a pre-stressed elastomer.

In another additional feature of that aspect of the invention, the container wall includes a hard shell member, the opening is defined in the hard shell member, and the receptacle is mounted to the hard-shell member. In another additional feature if that aspect of the invention, the receptacle has a member for obstructing the opening when the receptacle is empty. In a still further additional feature of that aspect of the invention, the receptacle has a door located to obstruct the opening when the receptacle is empty, and the door is operable to open when engaged by an object to be introduced into the receptacle. In an additional feature of that additional feature, the door is biased toward a closed position.

In a yet further additional feature of that aspect of the invention, the container includes a cover attached to the container and moveable to overlie the receptacle. In an alternative additional feature of that aspect of the invention, the container has a sheltering member mounted to extend externally of the opening to shelter an object protruding from the receptacle through the opening. In an additional feature of that additional feature, the sheltering member is a shroud mounted to the container and moveable to a position overlying the opening. In a still further additional feature of that additional feature, the shroud member includes a collar and a drawstring for urging the collar to engage an object protruding from the receptacle.

In yet another additional feature of that aspect of the invention, the container is collapsible. In a still further additional feature of that aspect of the invention, the container includes a cover for the receptacle, and the receptacle and the cover have a pair of mating retainer elements, the retainer elements being engageable to hold the receptacle in the out-of-use position. In an additional feature of that additional feature, the receptacle has a pliable cylindrical sidewall mounted to extend inwardly of the wall of the container, and a base member attached to the sidewall at a distal end thereof One of the pair of mating retainer elements is mounted to the cover, the other is mounted to the base, and in the out-of-use position the sidewall is collapsed and the base member is located adjacent the cover.

In a still further additional feature of that aspect of the invention, the container has a top panel, a bottom panel, and a sidewall panel extending therebetween, and the opening is defined in the sidewall panel. In an additional feature of that additional feature, the opening is defined in the sidewall adjacent to the bottom panel whereby, in use, an object introduced into the receptacle is supported by the bottom panel.

In a further aspect of the invention, there is an insulated container having a container wall and an insulated space defined therewithin. The wall has an opening defined therein. A receptacle is mounted to extend inwardly of the wall into the space, the receptacle being positioned to permit an object seated therein to protrude through the opening outwardly of the container. The receptacle has a thermal storage medium mounted thereto.

In an additional feature of that aspect of the invention, the thermal storage medium is a cooling pack element for providing cooling. In another additional feature of that aspect of the invention, the receptacle has a sidewall extending from the wall of the container, and a distal end. The thermal storage medium is a cooling pack element in the form of a puck mounted to the distal end of the well. In another additional feature of that aspect of the invention, the receptacle has a sidewall extending inwardly from the wall of the container, and the thermal storage medium is a cooling pack element extending about at least a portion of the sidewall.

These and other aspects, features and advantages of the present invention will be apparent from and clearly understood through a consideration of the following detailed description.

BRIEF DESCRIPTION OF THE DRAWINGS

The principles of the invention are explained below with the aid of the following illustrative Figures:

FIG. 6*a* is an isometric view of the container of FIGS. 4*a* and 4*b* taken from the same vantage point as FIG. 4*b*, showing the container in a fully collapsed condition;

DETAILED DESCRIPTION OF THE INVENTION

Figure 2:
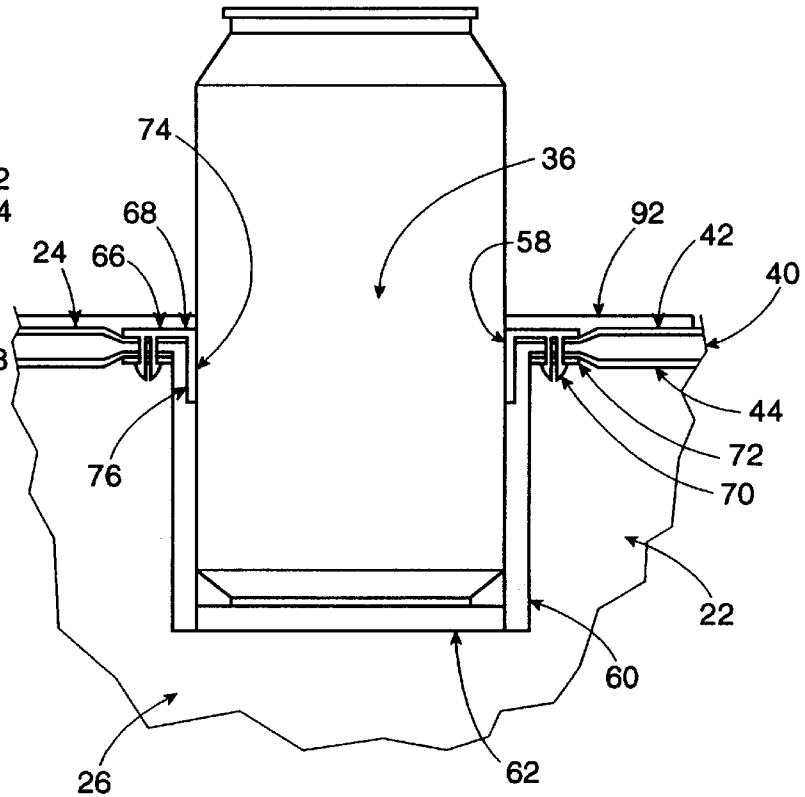
FIG. 2 is a detailed, cut-away generally cross-sectional view illustrating an embodiment of the externally accessible receptacle, shown with a can of soda positioned therewithin.

The description which follows, and the embodiments described therein, are provided by way of illustration of an example, or examples of particular embodiments of the principles of the present invention. These examples are provided for the purposes of explanation, and not of limitation, of those principles and of the invention. In the description which follows, like parts are marked throughout the specification and the drawings with the same respective reference numerals. The drawings are not necessarily to scale and in some instances proportions may have been exaggerated in order more clearly to depict certain features of the invention.

A preferred embodiment of the portable insulated case according to the invention is generally illustrated as 20. Portable insulated case 20 defines an insulated enclosure volume, generally designated at 22. This volume is adequate to accommodate an assortment of food, or drink items or both, which can be held within the case 20 when closed.

Case 20 includes a top panel 24, a bottom panel (not shown) and a sidewall panel 26. Sidewall panel 26, such as that illustrated, has four side portions 28, 30, 32 and 34 in a generally rectangular upstanding arrangement. Other configurations, arrangements or designs can be pactised in order to provide a desired container shaping and sizing. Whatever arrangement of panels is chosen, insulated case 20 should be water-tight.

It will be noted that the top panel 24 includes an opening 36 therethrough. The illustrated embodiment also shows a second opening 38. It will be appreciated that three or more openings could also be provided, depending upon the size of the top panel and the intended requirements or selected specifications of the portable insulated case.

Each panel of the portable insulated case 20 has insulative properties in that heat transfer is retarded across the panel. An example of a suitable panel construction in this regard includes an internal core of foam 40. Suitable foam polymers include ethylpropylene ethylene (EPE). A typical core will be about 8mm thick. External to, or on opposite sides thereof, are an outer protective and decorative layer of polymer sheeting 22 and another inner protective and decorative layer of polymer sheeting 44. Layers 22 and 44 are preferably made of a material suitable for cleaning. A suitable material in this regard is nylon (T.M.) sheeting. Other suitable materials and combinations of materials may also be found.

In order to maintain the soft-sided characteristic of the portable insulated case, it is preferred that at least sidewall panel 26 be pliable. In the preferred embodiment illustrated top panel 24 bottom panel (not visible) also will be pliable. The soft-walled nature of the panels renders them more comfortable to handle, more easily fit into tight spaces when required, and generally lighter in weight.

A closure member or assembly, such as the illustrated zipper 46, is positioned with respect to the top panel 24 and sidewall panel 26 such that top panel 24 is openable. Other closure members or assemblies are possible, such as snaps, hook-and-loop arrangements, string ties, and the like. The exact location of the selected closure member can vary, provided it allows for selective opening and closing of all, or a large portion of, top panel 24, either alone or together with an upper portion of sidewall panel 26. It is preferred that at least a portion of top panel 24 be able to remain attached to the rest of portable insulated case 20. For example, in the embodiment illustrated in FIG. 3, the top panel remains attached to the sidewall along a hinge or edge area 48.

Figure 3:
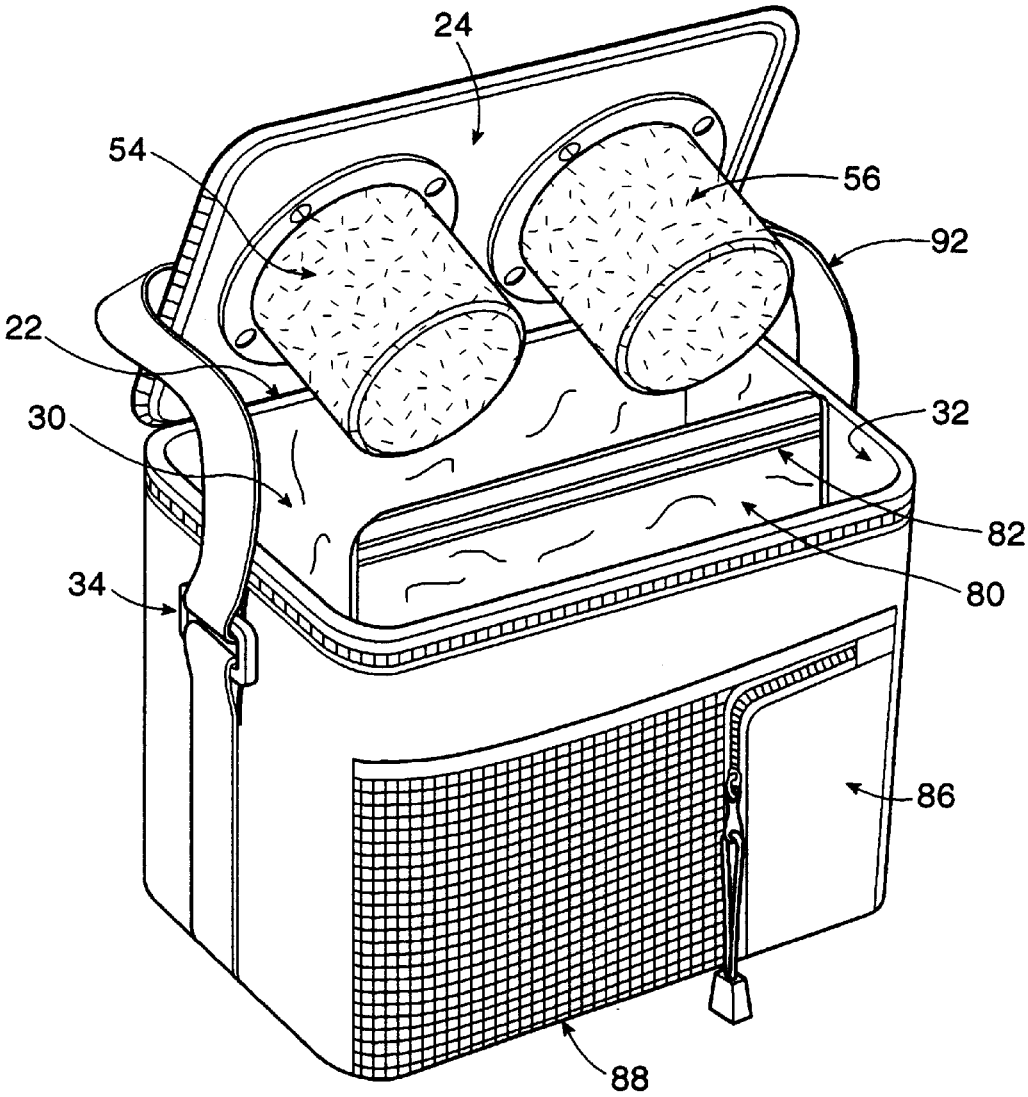
FIG. 3 is a perspective view of the embodiment as generally shown in FIG. 1, with the portable insulated case being shown in an open configuration.

When the portable insulated case 20 is in the open configuration illustrated in FIG. 3, the user has access to insulated enclosure volume 22, thereby allowing items such as filled drink cans 50 and filled drink bottles 52, whether glass or plastic, to be placed within and removed from insulated enclosure volume 22. Access is thus permitted to one or more selected cans 50, bottles 52 or the like, without having to undo the closure member, open the top, and thereby permit undesirable heat transfer through the resulting open area, whether the transfer be into the insulated case (when it is a cooler) or out of the insulated case (when it functions to keep warm items warm).

A pair of externally accessible receptacles is provided. Each receptacle 54, 56 is in general alignment with a respective one of openings 36, 38 in top panel 24. In an alternative embodiment, each externally accessible receptacle may take a general form desired for the particular end use. These include sleeves, pockets, shaped cylinders and the like. Each such receptacle 54, 56 includes a mouth 58. In the illustrated embodiment, each mouth 58 conforms to the shape of the opening 36, 38 and has a perimeter size slightly less than that of the opening 36, 38. Mouth 38 is selected to have a perimeter and size which closely approximates the external perimeter shape and size of the can, bottle or the like to be held such as can 50 or bottle 52, illustrated. Each Receptacle 54, 56 provides a downwardly depending structure which accommodates at least a substantial portion of the volume of the can, bottle or the like. Preferably, the height of the receptacle is less than the total height of the can, bottle or the like in order to permit, and to facilitate digital access to can 50, bottle 52 or such other object as may be seated therein; that is, a user can grasp and remove the can 50, bottle 52 or the like from out of receptacle 54, 56 when desired, such as in order to drink from, or pour from, can 50, bottle 52 or the like.

The structure of receptacle 54 or 56 which is illustrated in the drawings. It includes a downwardly depending sidewall 60 which is generally vertically oriented when portable insulated case 20 is in the upright position as illustrated in the Figures. The illustrated receptacle 54, 56 further includes a bottom wall 62 upon which can 50, bottle 52 or the like can rest. In the illustrated form, downwardly depending sidewall 60 has the configuration of a right cylinder, and the bottom wall 62 takes on the shape of a disc. This shaping is suited for closely accommodating illustrated can 50 or bottle 52.

Preferably, the inner diameter of the downwardly depending sidewall 60 approximates that of a typical can 50 or bottle 52. It is especially preferred that at least the downwardly depending sidewall 60 be made of a pliable and somewhat resilient material. In that instance, the inside diameter of the sidewall 26 can be slightly greater than the outside diameter of the container whether can 50 or bottle 52 so that the container will slightly compress that is to say, will have an interference fit with, sidewall 60 so as to enhance the gripping security imparted by receptacle 54 or 56 onto the container, be it can 50 or bottle 52. A material found to be suitable in this regard is poly (2-chloro-1,3-butadiene), also known as polychloroprene or neoprene (T.M.). Other synthetic rubber materials or pliable and resilient polymers can be used, for example. For convenience, the bottom wall 62 can be made of the same material as the downwardly depending sidewall 60. Preferably, the material of the receptacle is a waterproof material. That is, if liquid should spill from can 50 or bottle 52, for example, it will tend to be held within receptacle 54 or 56 and thereby be discouraged from dripping or leaking into insulated enclosure volume 22.

When empty, receptacles of rubber, or synthetic rubber foams, including open celled foams, and some closed cell foams, generally having a nylon or vinyl skin on the receptacle inside and outside walls, have been found to deflect or collapse when forced against more robust objects inside the case. While a collapsible, or crushable receptacle is preferred, it is possible to make receptacles similar to receptacles 54 and 56 of a substantially rigid material intended to resist crushing. By way of example, an ABS, hard nylon, or other stiff polymer, or aluminum or stainless steel receptacle could be employed where more rigid properties are desired.

Although receptacles 54 and 56 have been illustrated as having a generally round, right cylindrical shape, one or the other, or both, could have a different cross-sectional profile, whether square, rectangular, elliptical, oval, hexagonal, octagonal, D-shaped, or some other shape. Receptacles 54 and 56 could have different cross-sectional shapes, and could be of different sizes. For example, one may have a diameter for receiving a 355 ml soft drink can, the other may have a diameter for receiving a 385 ml can. Alternatively, one or the other, or both, may be sized to receive a 750 ml or other capacity bottle such as a wine or soft drink bottle, or a 1 quart, 2 quart, or other capacity milk or juice carton. It should also be noted that while illustrated as being generally cylindrical, the well of each receptacle may be tapered, typically being narrower at the innermost end of the well than at the mouth. In the case of a moulded receptacle, a taper in the nature of a draft angle may facilitate removal from the mould. Alternatively, a modest taper, or a chamfer at the receptacle mouth, may facilitate entry of a bottle, can, or other object into the receptacle. These variations of size and shape are applicable as well to any of the other embodiments of the invention described herein.

Receptacles 54 and 56 are to be mounted integrally with top panel 24 at openings 36, 38. Single-piece construction is possible in this regard, although often an assembly can be somewhat more convenient, particularly when the receptacle material is different from that of top panel 24. As illustrated, a flange member 66 can be used to join the receptacle to the top panel. Illustrated flange member 66 includes a horizontal plate 68 which overlies the opening 36, 38 and the adjacent edge of the top panel 24. A plurality of fastening devices in the nature of flexing fasteners 70 project from horizontal plate 68 and into and through the top panel 24. Horizontal backing plate 72 are included to enhance the security of the connection between fasteners 70 and top panel 24. In this regard, the fasteners 70 pass through respective openings provided in separate horizontal backing plate 72. Fasteners 70 snap into place thereat.

Flange member 66 also includes a vertical annular leg 74 which downwardly depends from the horizontal plate 68. A cut-out or indent in the nature of a shouldered annular rabbet 76 is provided in receptacle sidewall 60 to accommodate the thickness and height of vertical annular leg 74. Alternatively, any inherent flexibility of the receptacle material can permit compression of that material which is under the vertical annular leg 74. By either approach, the exposed surface of the vertical plate is flush with the inside surface of receptacle sidewall 60, or, alternatively vertical annular leg 74 is slightly indented with respect to receptacle sidewall 60. The surface of receptacle 54 or 56 will thus engage the container, whether can 50 or bottle 52, when seated within receptacle 54 or 56.

Typically, insulated enclosure volume 22 of case 20 will also contain a thermal energy storage medium to act as a heat source or sink. Such a medium can be an object in the nature of a cooling source at a temperature below room temperature and, moreover, typically below the freezing point of water. Ice or commercially available freezing packs are suitable. FIG. 3 illustrates the use of a heavy duty pouch 80 having easy openable and closeable means, in the nature of mating profile strips 82. Refrigerator ice or the like can be inserted into pouch 80 to contain, for example, ice as it melts into water.

Receptacles 54 and 56 depend downwardly from top panel 24 into the insulated enclosure volume 22 and thus (when the insulated case is a cooler) within the cool environment of insulated enclosure volume 22. Items in volume 22 include the cooling member, typically included within, for example, heavy duty pouch 80 containing ice cubes or the like. Also often contributing to this cool environment within insulated enclosure volume 22 are other drink or food items enclosed therewithin. Because the receptacles extend into this environment, they can be positively affected by the environment of the insulated enclosure.

Figure 1:
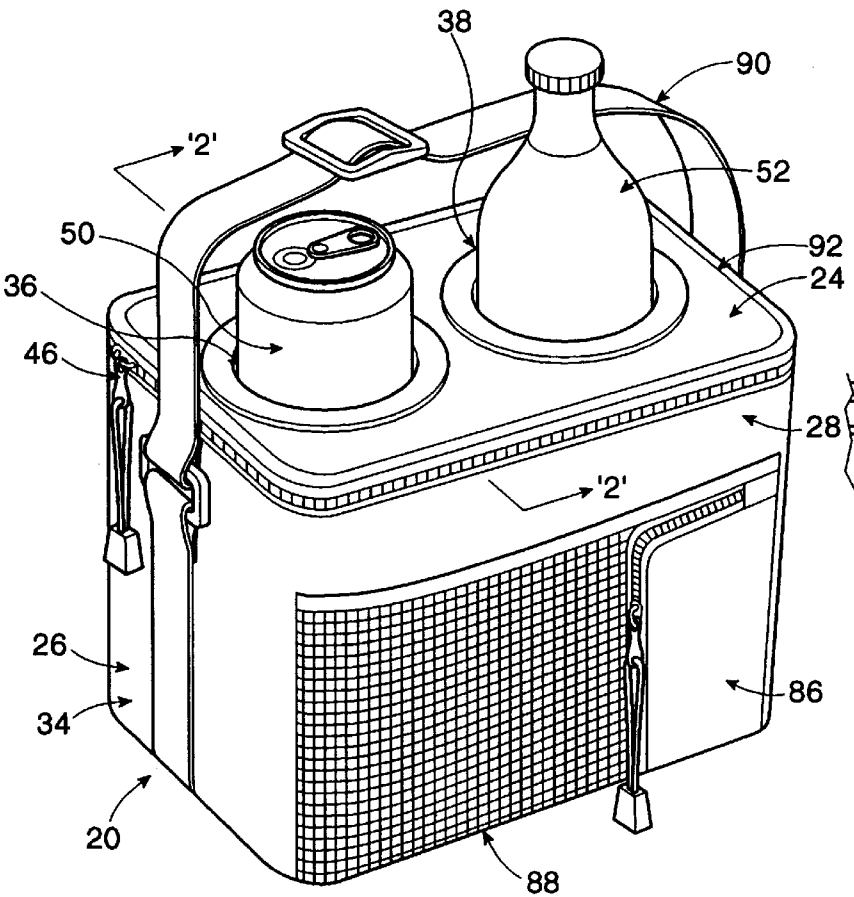
FIG. 1 is a perspective view of a preferred form of the portable insulated case according to the invention.

More specifically, depending upon the material out of which the receptacles are made, for example the material of the downwardly depending sidewall 60 and bottom wall 62, a certain degree of heat transfer can occur across the walls of the receptacle. When this feature is provided, a can of soda, for example, which is well below room temperature when within insulated enclosure volume 22 may still tend to be subjected to the cooling environment of the insulated enclosure even after it is removed from volume 22 and placed within one of receptacles 54 or 56, as seen in FIG. 1 and FIG. 2. When this feature is provided, the walls of the receptacle, whether downwardly depending sidewall 60 or bottom wall 62, allow a greater degree of heat transfer through them than is allowed by the panels of the portable insulated case 20. It will be appreciated that, under this circumstance, the rate of thermal transfer through the receptacle walls will be faster than through the case panels.

When a can, bottle, or the like, is positioned within a receptacle, there occurs a reduction of heat transfer out of the can, bottle, or the like, and into the surrounding ambient environments. Maintaining a cool item cool also is achieved in part because a substantial portion of the can, bottle or the like is shaded from the sun or other heat generating sources by virtue of its being enclosed within receptacle 54 or 56. In addition, receptacle 54 or 56 itself has an insulative effect on that portion of can 50, bottle 52 or the like which is enclosed within the receptacle. Such insulating effects occur irrespective of any cooling effect imparted through the receptacle wall by virtue of the cool environment of the insulated enclosure volume 22.

All of the features described above provide a beneficial effect. Each contributes to the advantage of the invention of assisting in keeping the can, bottle, or the like, cool while same is securely held within one of the receptacles according to the invention. Receptacles 54 and 56 tend to prevent spillage of an open drink, for example, while also tending to assist in keeping the drink cool for a longer period of time than is achieved by approaches which do not combine a holding function with a cooling function.

The illustrated portable insulated case 20 includes a zippered security pocket 86 which is provided for convenient storage of smaller items such as keys, money, wallets, watches, personal items and the like. It will be appreciated that the illustrated zipper can be substituted for by using other closure arrangements. Also illustrated is an outside mesh pocket 88, which can be suitable for storing other items such as glasses, books, lotions and the like. The bottom panel (not shown) of the portable insulated case 22 is preferably made of a non-skid, durable and water-resistant material, or has an outer layer composed of material having these properties. An adjustable carrying strap 90 can be included as shown.

While the illustrations of the invention which are specifically shown herein indicate a fully open mouth 58 for each of the receptacles, it will be appreciated that temporary covers or closures can be included. For example, when it is desired to allow for closure of each receptacle mouth 58 when can 50 or the like is not within the receptacle, a sheet of material (or other structure) can be positioned for temporary full closure or partial closure of one (or of each) receptacle mouth. A top cover panel 52 is shown in phantom in FIG. 1 and in FIG. 2. A panel of this type can be provided. This allows the user to cover each receptacle mouth until it is desired to use the receptacle for holding and maintaining coolness (or warmth) of the can, bottle or the like by sorting it in the receptacle. Such a top cover panel can be temporarily secured to the outside of the insulated case by any suitable connection means, such as zipper, hook-and-loop components, snaps, tabs, tie strings and the like (not shown).

A total of two receptacles are shown in FIG. 1 and FIG. 3. Other possible variations provide a single receptacle, which would be particularly suitable for use by a single person. Larger portable insulated cases can include a greater number of receptacles to accommodate a greater number of users. Correspondingly, the portable insulated case itself typically is larger in volume when there are more receptacles. In the illustrated arrangement of FIGS. 1, 2 and 3 a single-receptacle portable insulated case will accommodate from four to six 12-ounce cans, a dual receptacle portable insulated case will accommodate about twelve such cans, and a triple-receptacle portable insulated case will accommodate twenty-four such cans.

In an alternative embodiment of the invention, a collapsible insulated portable soft sided container 100 is shown in fully expanded, partially collapsed and fully collapsed positions in FIGS. 4*a* and 4*b*, FIGS. 5*a* and 5*b*, and FIGS. 6*a* and 6*b* respectively. It has an insulated shell 102 having a top wall, in the nature of a top panel 104, a bottom panel 106 (shown in FIG. 7*a*), and sidewall panelling 108 extending between top and bottom panels 104 and 106. Panelling 108 has four facing portions, being front, rear, left-hand and right-hand facing portions 110, 112, 114, and 116 respectively that define a generally rectangular container section of dimensions corresponding to the four side edges of each of top and bottom panels 104 and 106. It may be noted that although panels 104 and 106 are of the same dimensions, such that portions 110, 112, 114 and 116 are each rectangular and share a common height, this need not necessarily be so. A pyramidal, inverted pyramidal, two sided cradle, or other form could be assembled.

A closure member, in the nature of a zipper 120, extends about three edges 121,122, and 123 of top panel 104, for mating with corresponding edges 124, 125 and 126 of front, left hand, and right hand facing portions 110, 114 and 116. Rear edge 127 of top panel 104 meets the top edge 128 of rear facing portion 112 at a juncture in the nature of a folding hinge 130. Zipper 120 is movable between a fully closed position in which all edges of top panel 104 are joined to the remainder of container 120, and a fully open position in which top panel 104 is free to move upwardly and rearwardly on hinge 130, thus giving access to a storage space 132 defined within shell 102. By this access means a person may introduce or remove beverages, food items, or other objects from space 132.

Container 100 has a carrying strap 134 of adjustable length by which container 120 may be lifted, with attachments on left and right hand facing portions 114 and 116. A reinforcing band 136 is mounted about the external periphery of sidewall 108 of container 120, at a level intermediate the top and bottom panels. Band 136 has, on a front facing portion thereof, an attachment member in the nature of a male or female hook-and-eye fabric attachment strip 138. A corresponding female or male hook-and-eye fabric attachment strip is located on the inner face of top panel 104 near its distal edge, namely front edge 121. Zipper 120 can be moved to its fully open position to permit top panel 104 to be drawn forwardly and downwardly such that the hook-and-eye fabric strips engage, yielding the partially collapsed position shown in FIGS. 5*a* and 5*b*.

Figure 6A:
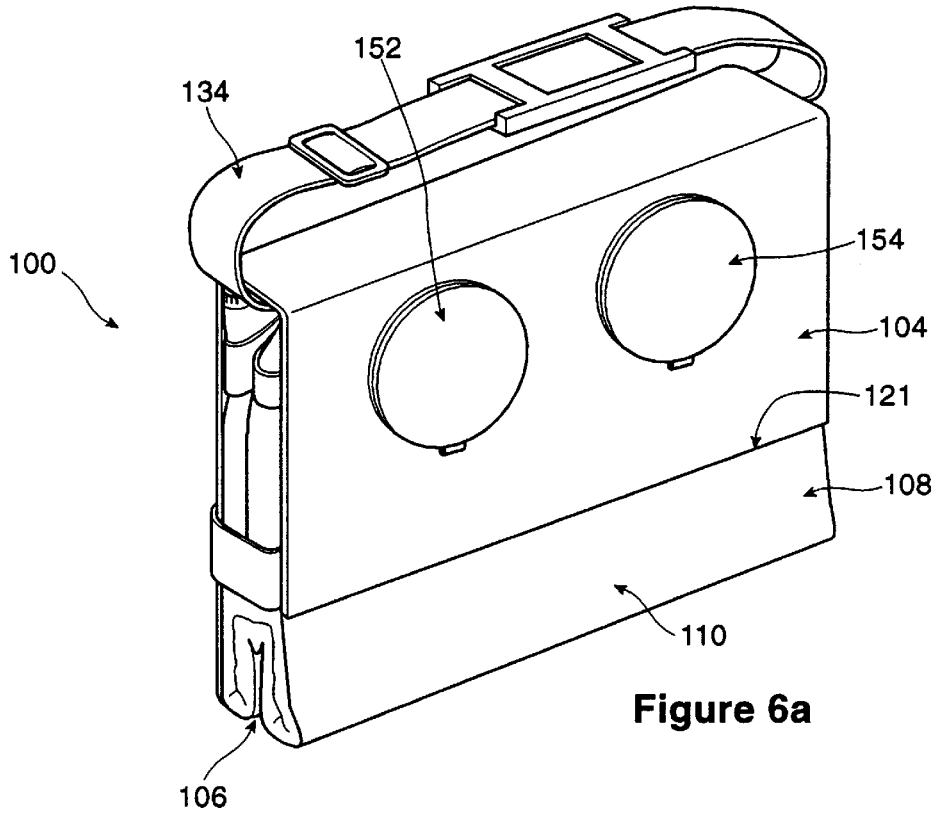
FIG. 6*a* is an isometric view of the container of FIGS. 4*a* and 4*b* taken from the view point as FIG. 4*b*, the container being in a fully collapsed condition.
Figure 6B:
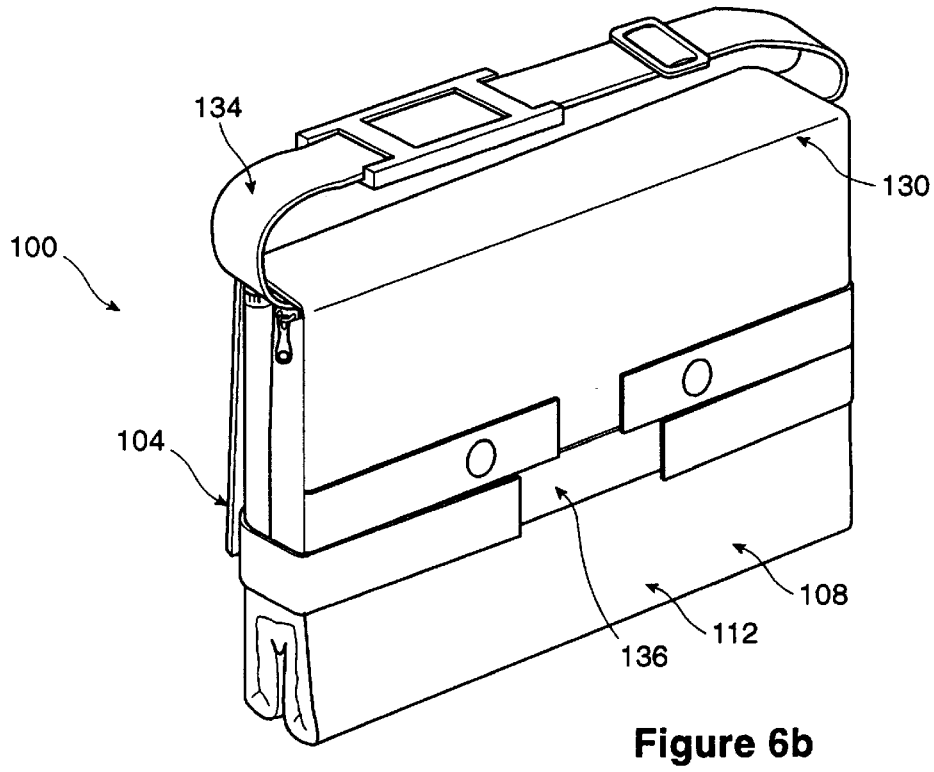

Band 136 also has a pair of left and right hand closure tabs 140 and 142 attached, by means of sewing, at the vertices formed at the junctures, respectively of front facing portion 110 and left hand and right hand facing portions 114 and 116, at a level corresponding generally to that of band 136. The inner faces of tabs 140 and 142 have hook-any-eye fastener strips. Band 136 has corresponding mating tab holder hook and eye fastener strips 144 and 146, on the left and right hand facing portions 114 and 116 of sidewall 108, to provide a land for tabs 140 and 142 when container 100 is in its fully open or partially open positions as shown in FIGS. 4*a* and 4*b*, and FIGS. 5*a* and 5*b* respectively. Band 136 also has, on rearwardly facing portion 112, a pair of mating tab securing position hook and eye fastener strips 148 and 150, such as are engaged by tabs 140 and 142 when container 100 is in its fully collapsed position, as shown in FIG. 6*a* and 6*b*.

Top panel 104 of container 100 has a pair of receptacles indicated generally as 152 and 154. Each is mounted in an opening 156 or 158 let through top panel 104. Receptacles 152 and 154 are identical in construction. Receptacle 152 has a flanged fitting assembly 160 by which it is mounted to top panel 104, a depending well assembly 162 mounted to assembly 160 (and top panel 104) for receiving, for example, can 50 or bottle 52, and a cover assembly 162, also mounted to assembly 160, for covering receptacle 152 when it is not in use.

Flanged fitting assembly 160 includes an annular member 166 having a substantially planar, annular, radially outwardly extending flange in the nature of a leg member 168, and a substantially downwardly extending, round cylindrical inner leg member 170 forming the inner lip of receptacle 152. A capture, or backing member, in the form of a backing ring 172 is used to clamp against the upper and lower skin 174 and 176 of top panel 104, compressing insulation layer 178 in the process. Backing ring 172 is secured in place by clinching fasteners 180. A number of different types of fastener could be used for this purpose, such as screws, rivets, snap fit plastic prongs, bonding inserts or other similar means. In the embodiment illustrated in FIG. 7*b*, fasteners 180 are formed integrally with leg members 168 and 170, and have a split prong for insertion through mating apertures in backing ring 172.

Depending well assembly 162 has a downwardly extending peripheral wall member 182 in the nature of a waterproof skirt or membrane having a closed base portion 184. A circular seat 186 is bonded within wall member 182 to rest upon base portion 184. A can 50, or bottle 52 placed within receptacle 152 can stand upon seat 186. The upper edge of wall member 182 extends about the outside face of leg member 170, and is also captured in place by backing ring 172.

Figure 7A:
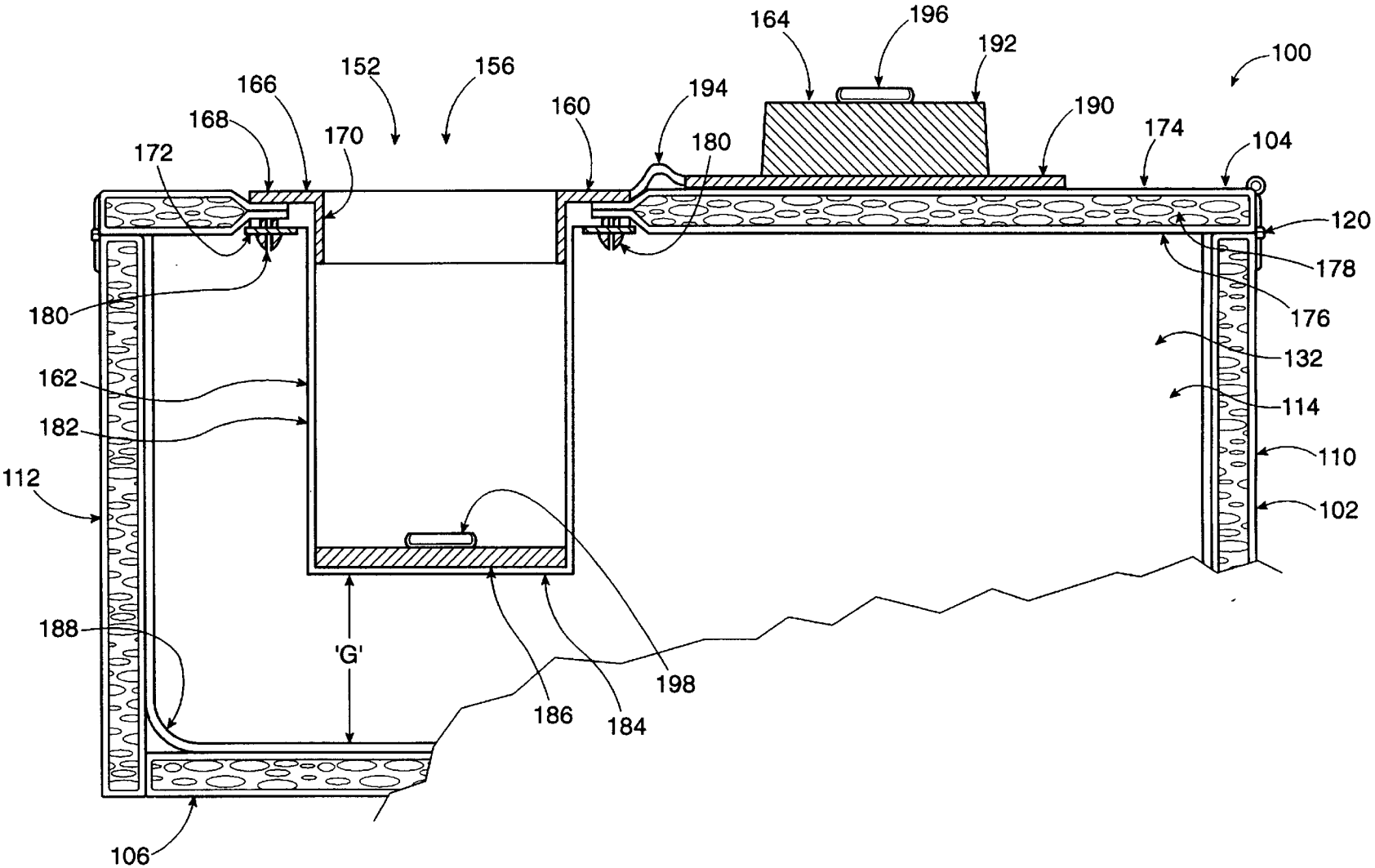
FIG. 7*a* is a cross-sectional view of the container of FIG. 4*a* taken on section "7*a*–7*a*", showing a receptacle in an open, and extended, position.
Figure 7B:
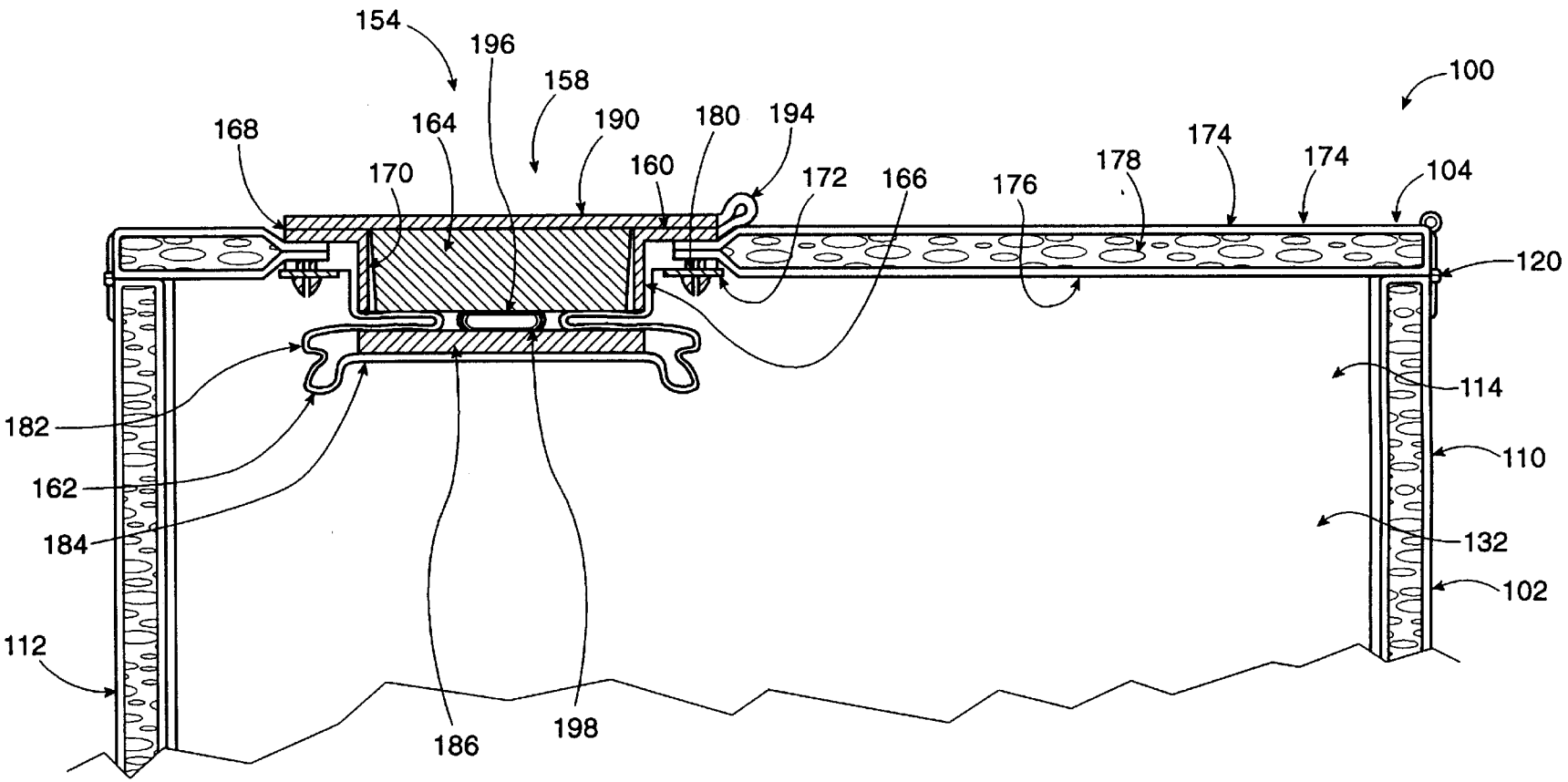
FIG. 7*b* is a cross-sectional view of the container of FIG. 4*a* taken on section "7*b*–7*b*", showing a receptacle in a closed position.

Cover assembly 164 includes a lid 190, a stopper 192 centrally located relative to lid 190 and sized to fit within round cylindrical leg member 170 of flanged fitting assembly 160, a hinge member 194 joining lid 190 to outwardly extending leg member 168, and a detachable attachment fitting in the nature of a male (or female) snap 196 for mating with a female (or male) snap 198 centrally mounted on seat 186 of well assembly 162. Other types of mating attachment fitting could be used, such as hook-and eye fittings, magnetic fittings, a suction cup fitting, a ball-in-socket interference fitting, a half-turn or quarter turn twisting fastener fitting or other releasable attachment means by which seat 186 can temporarily be joined to cover assembly 164 as shown in FIG. 7*b*. The position shown in FIG. 7*b* is the closed, or storage position of receptacle 152 (or 154). In this position the space within insulated shell 102 that would otherwise be occupied by receptacle 152 (or 154) can more easily be used for the storage or carriage of other objects.

The collapsibility of receptacles 152 and 154 tends to enhance their suitability for use in a collapsible container such as container 100. For example, in the partially collapsed condition illustrated in FIGS. 5*a* and 5*b*, and in the fully collapsed condition of FIGS. 6*a* and 6*b*, receptacles 152 and 154 have their cover assemblies in place, and, although not visible, their well assemblies collapsed to permit top panel 104 to be drawn down relatively tightly over the upper portion of front facing panel 110 to permit the hook-and eye fasteners to mate. Notably, in the fully collapsed condition, the major portion of top panel 104 remains substantially planar, as do front and rear facing portions 110 and 112, whereas side facing panels 114 and 116 and bottom panel 106, tend to be folded centrally.

It is not necessary that a releasable fastener, or any type of fastening means, be used for temporary linking of seat 186 to cover assembly 164. In the embodiment illustrated in FIGS. 7*a* and 7*b* sidewall member 170 is a substantially inelastic waterproof webbing material, such that when placed in the closed position it bunches and folds in the irregular manner indicated. Elasticized bands could be used to encourage more regular folding if desired. The flexibility of sidewall member 174 is such that when not in use, it tends to present little resistance to collapse upon encountering objects within space 132 generally. There are other means by which a collapsible receptacle can be formed, including the use of an easily deflected spongy material, a rubber or synthetic rubber cup or similar structure. It is advantageous that the material chosen for wall member 182 have a considerably higher thermal conductivity than an equivalent area of insulated shell 102, so that an object in receptacle 152 (or 154) may be subject to heat loss (or gain) from space 132 more readily than with the external ambient environment. A similar consideration applies to seat 186. By a similar token, it is desirable that stopper 192 have a resistance to heat transfer comparable to the resistance of the adjacent portions of top panel 104 to discourage unwanted heat gain from, or heat loss to, space 132 when receptacle 152 (or 154) is not in use.

While cover assembly 164 is linked to flanged fitting assembly 160 by hinge member 194, it is possible to use other means to govern the relationship of cover assembly 164 to flanged fitting assembly 160, particularly for the purpose of preventing, or discouraging inadvertent loss of cover assembly 164 if not joined to container 100 in some manner. An external storage pocket could be provides, as could hook-and-eye, or other types of releasable fasteners. A retainer in the nature of a cable, strap, lanyard, or chain is also suitable for this purpose.

Figure 4A:
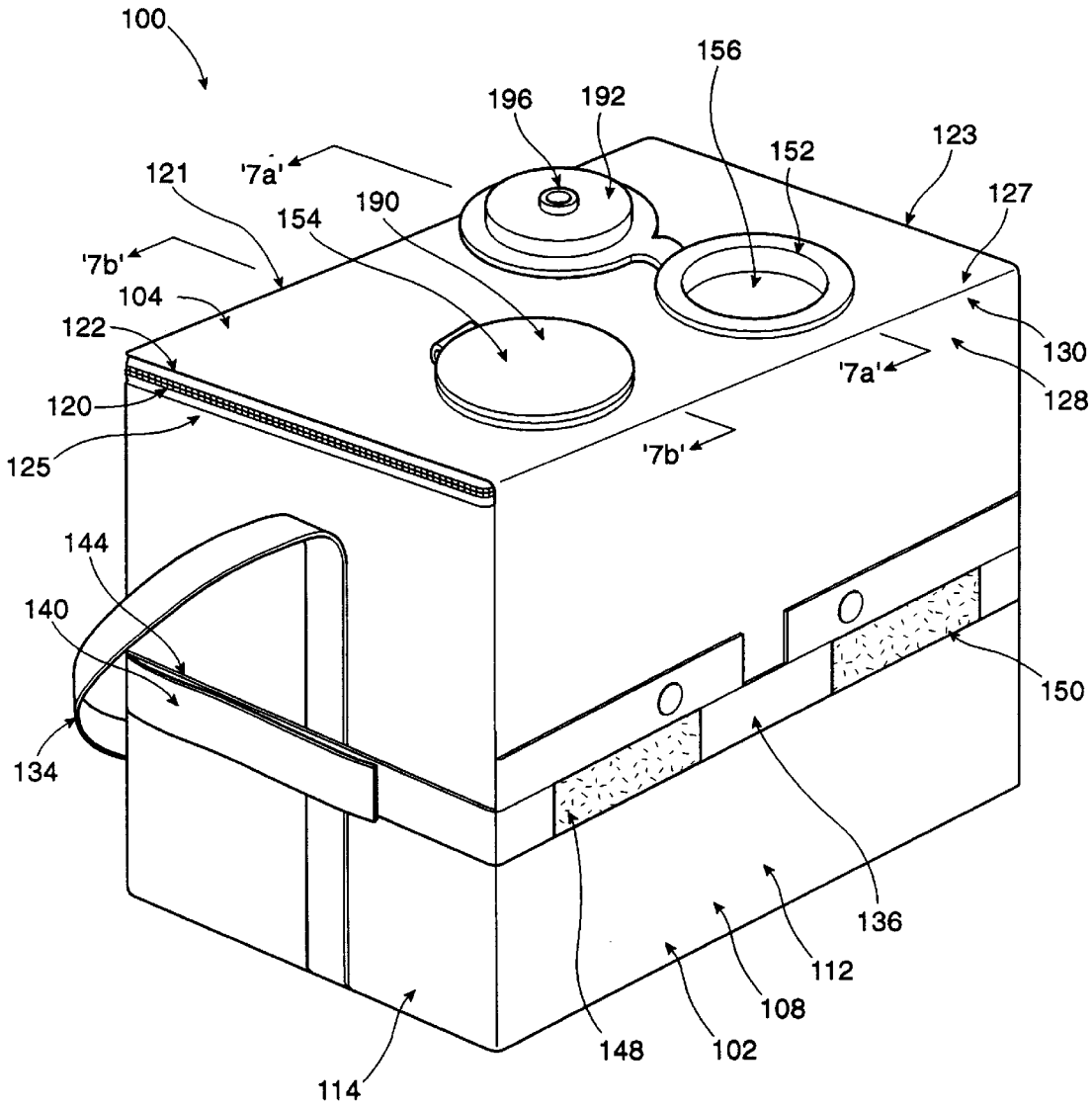
FIG. 4*a* is an isometric view, taken from above, behind and to the left side of an example of an embodiment of an insulated, collapsible soft sided, container in its fully expanded condition according to an aspect of the present invention.
Figure 4B:
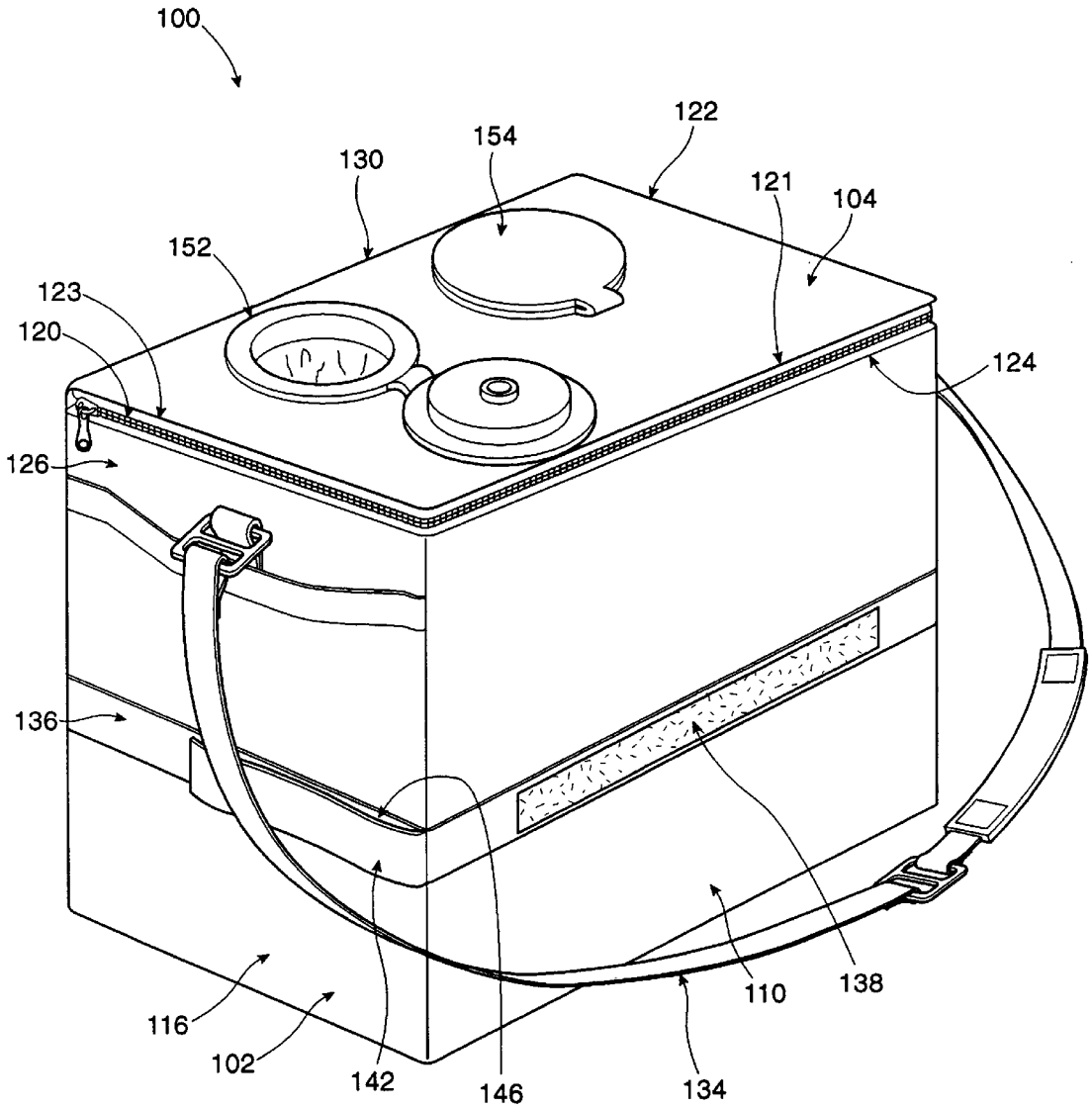
FIG. 4*b* is an isometric view of the insulated, collapsible soft sided, container of FIG. 4*a*, taken from above, infront, and to the right hand side thereof, in its fully expanded condition.
Figure 4C:
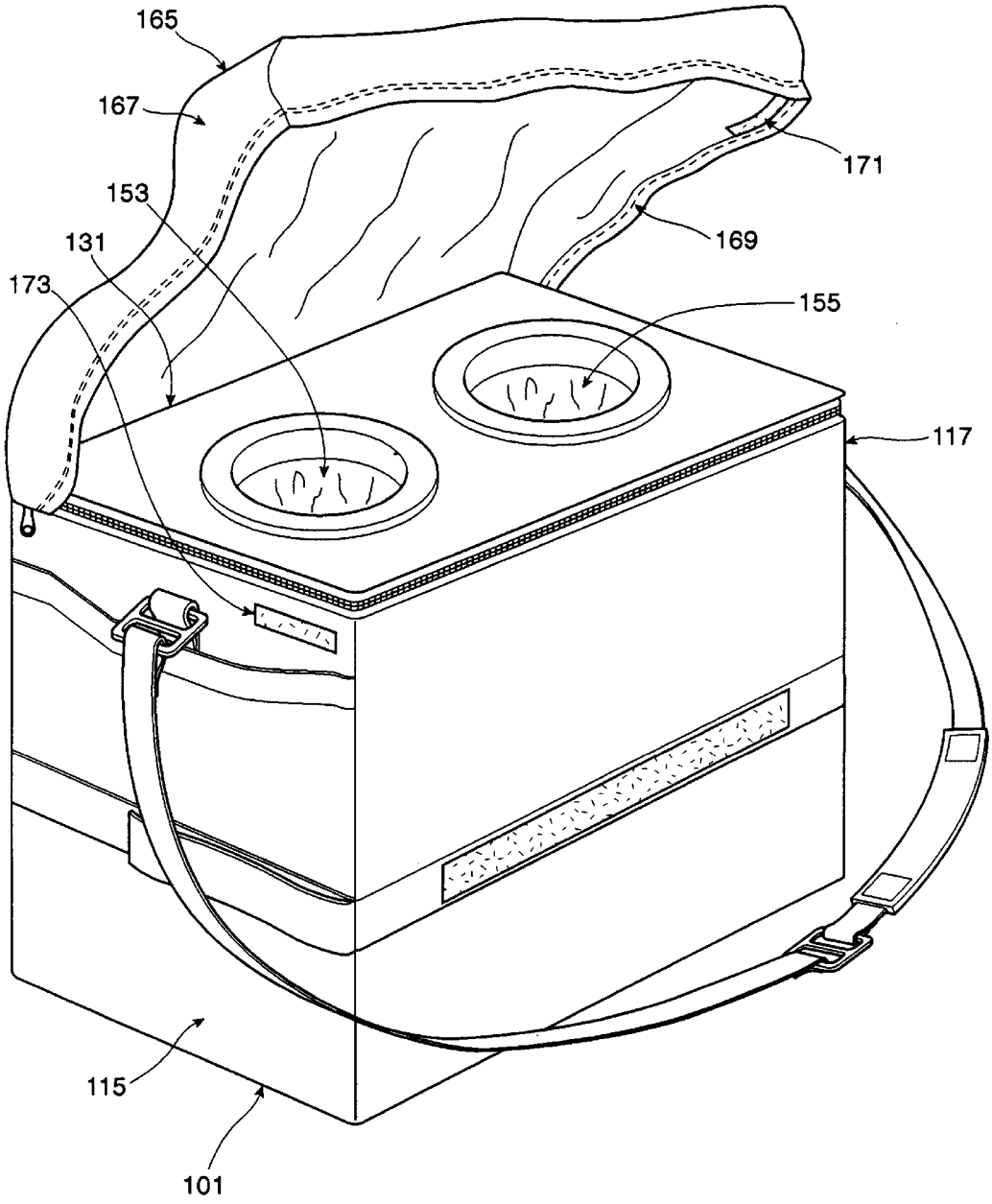
FIG. 4*c* shows a container similar to the container of FIG. 4*a* having an outer covering member.
Figure 5A:
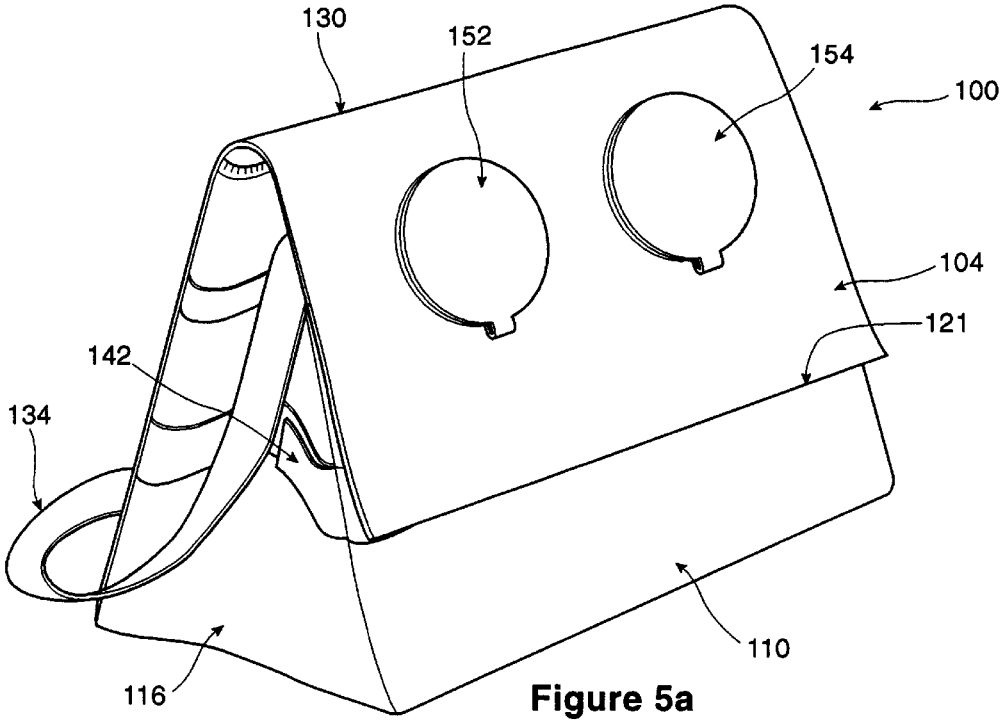
FIG. 5*a* is an isometric view of the container of FIGS. 4*a* and 4*b* taken from the same vantage point as FIG. 4*b*, showing the container in a partially collapsed condition.
Figure 5B:
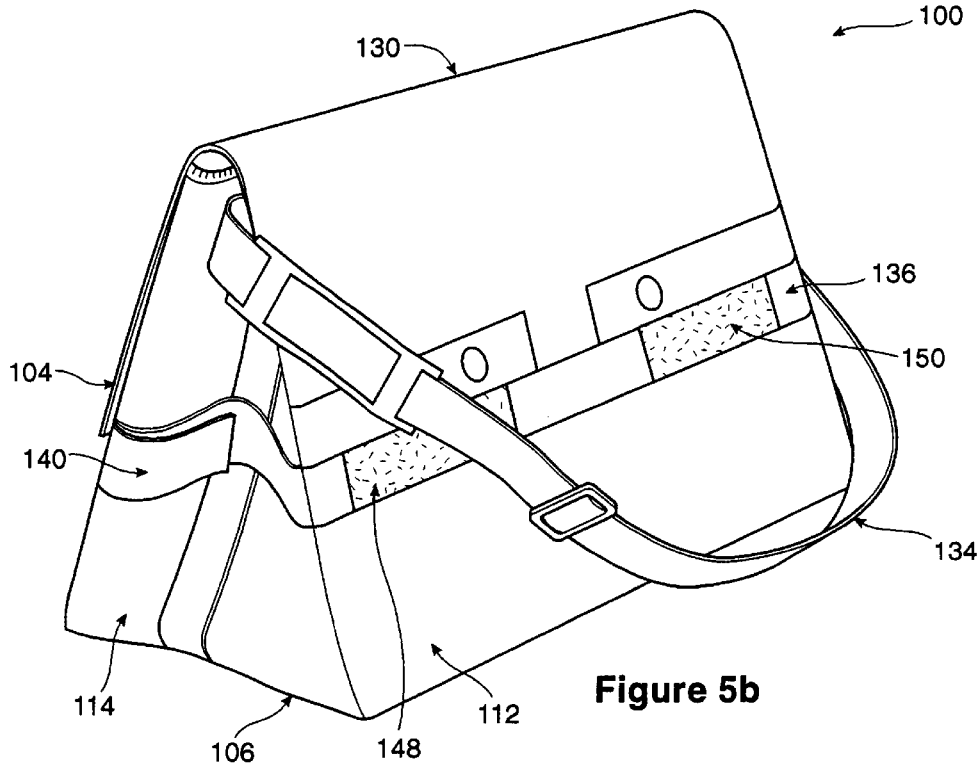
FIG. 5*b* is an isometric view of the container of FIGS. 4*a* and 4*b* taken from the view point as FIG. 4*a*, the container being in a partially collapsed condition.

It is not necessary that receptacles 152 and 154 have a cover. They could be open, as are receptacles 153 and 155 illustrated in FIG. 4*c*. Alternatively, in place of cover assembly 164, container 101, in other respects similar to container 100, has a fly, overlay, or cover 165. As illustrated in FIG. 4*c*, cover 165 is mounted to container 101 in the region of hinge 131, and has a three-sided depending skirt 167 for overlapping the edges of top panel 105. The lower hem of skirt 167 has an elastic strap sewn inside to cause the hem to draw snugly against container 101 in the manner of a fitted sheet. A drawstring or similar device could also be used. As an addition, or option, on the inside face of skirt 167, near hem 169, are hook-and-eye fabric strips 171 for engagement of mating hook-and-eye fabric strips 173 mounted to sidewalls left and right hand facing portions 115 and 117.

Although wall member 182 is circular, as is seat 186, this need not be so. Receptacle 152 could have a square, rectangular, hexagonal, D-shaped, or other cross-sectional profile. Well assembly 162 is shown in FIG. 7*a* as depending in a manner as to leave a clearance, in indicated as 'G', between base portion 184 and the upper face of bottom panel 106, or, as illustrated, from liner 188 that lies thereupon. The inner wall of receptacle 152 (that is, the wall surface closest to the can, bottle, or other objected seated in the receptacle) can have a vinyl sheet skin or liner.

Figure 8A:
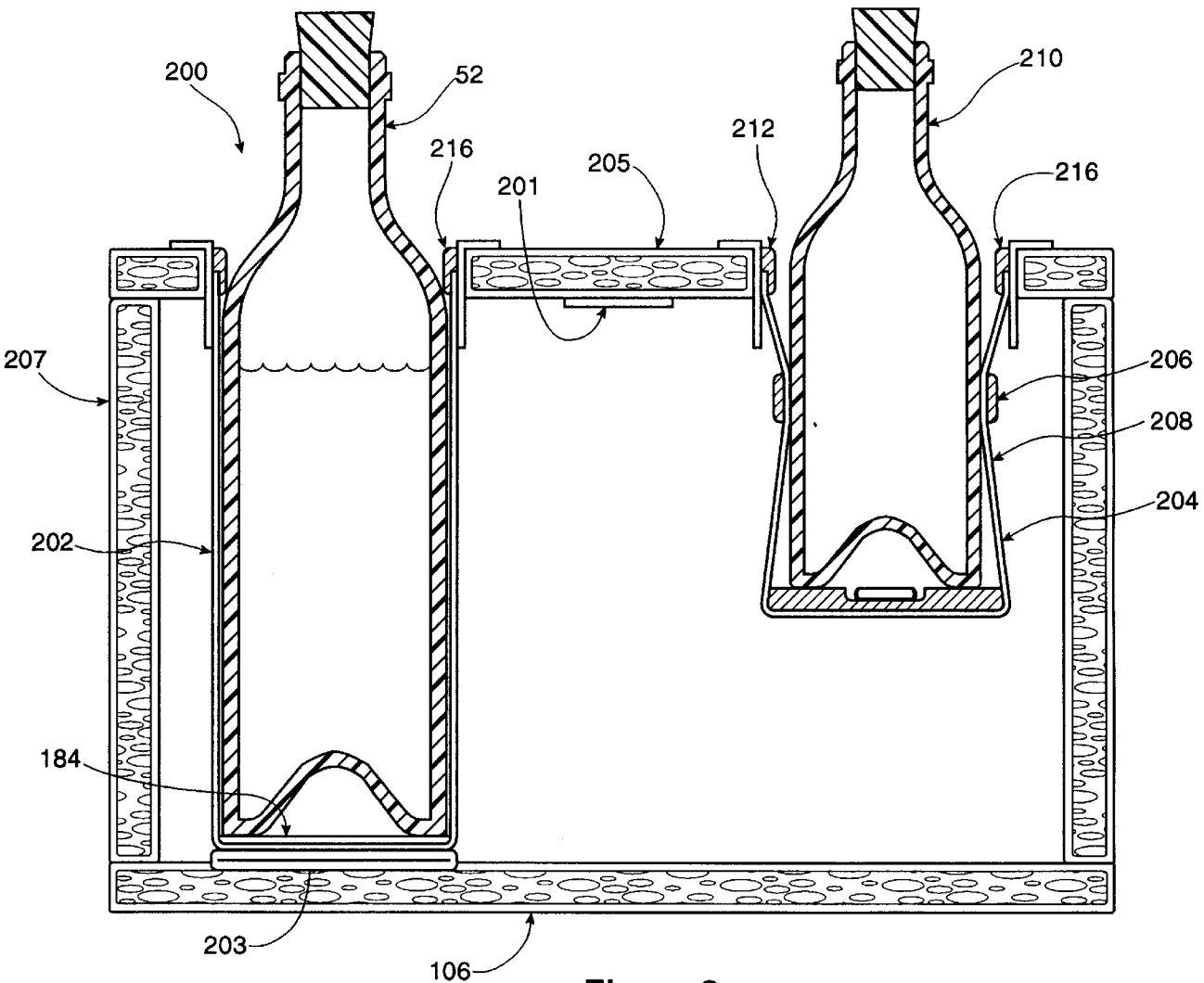
FIG. 8*a* shows a cross-section of an example of an alternative embodiment of a container similar to the container of FIG. 4*a*, having receptacles of different sizes.

In FIG. 8*a* an alternative embodiment of receptacle, indicated generally as 200, has a waterproof peripheral wall member 202 of sufficient longitudinal extent that base portion 184 rests upon, or is ultimately supported by, bottom panel 106. In the example illustrated a hook-and-eye fabric fastener, in the nature of a Velcro (T.M.) fastener has one strip mounted to the underside of the base of receptacle 200 and another, engageable part mounted to bottom panel 106 such that, in use, when the hook-and-eye fastener is engaged, base portion 184 is discouraged from shifting relative to bottom panel 106. This may tend to be desirable particularly when the container is being moved.

As an alternative storage positioning means to the mating snaps, 196 and 196, of FIGS. 7*a* and 7*b*, an auxiliary hook-and-eye strip 201 for engaging the hook-and eye-strip portion adjacent to base portion 184, is shown in FIG. 8*a* mounted to an upper region of the inside surface of top wall panel 205, and provides a stowage position for base portion 184 when receptacle 200 is not in use. Auxiliary strip 201 could also be located on the inside surface of sidewall 207, depending on the type of closure member used to provide access to the interior of the container.

Figure 8B:
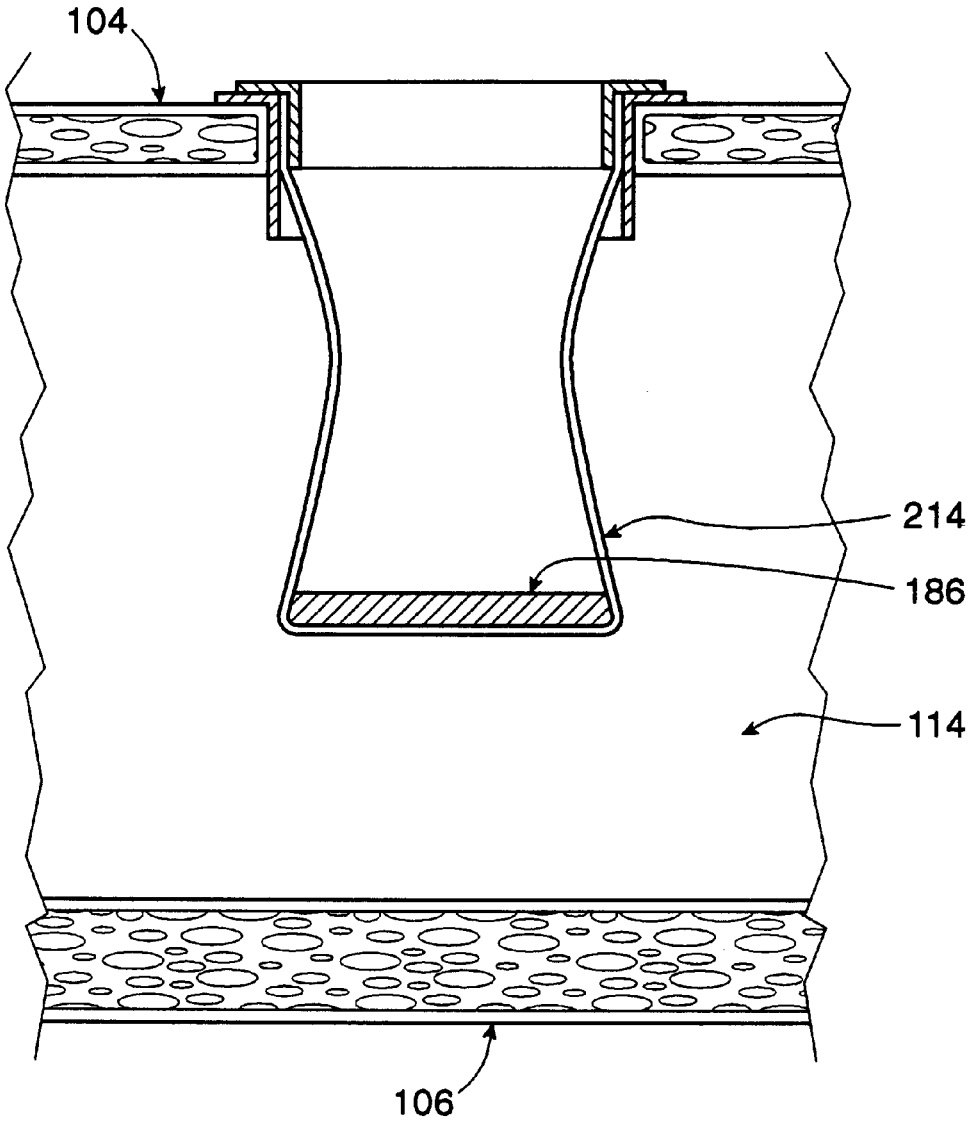
FIG. 8*b* shows a cross-section of an example of an alternative embodiment of a receptacle having an inwardly biased side-wall.

Also shown in FIG. 8*a*, an alternative well assembly 204 has a biasing member in the nature of an elasticized medial band 206 such that wall member 208 will be biased inwardly to engage the exterior of an object, such as bottle 210, located in assembly 204. More than one biasing member could be used, and other types of biasing members could be employed. For example, wall member 208 could be of a thickened, elastomeric foam construction presenting a profile, whether vertically ribbed or otherwise, extending inwardly of the circumference of the opening at lip 212 of assembly 204 to encourage an interference fit. In another alternative embodiment, wall member 208 could be replaced by a pre-stretched elastomeric wall, such as a rubber wall, stretched by a base plate, like item 184, and by a ring fitting, like flanged fitting assembly 160. The cross-sectional profile of the undeflected wall member 214 is generally as shown in FIG. 8*b*. Introduction of a bottle therein would tend to cause outward deflection of wall member 214, stretching it hoopwise. In both receptacle 200 and 204 an optional, deformable fender lip 216 is shown.

Figure 9A:
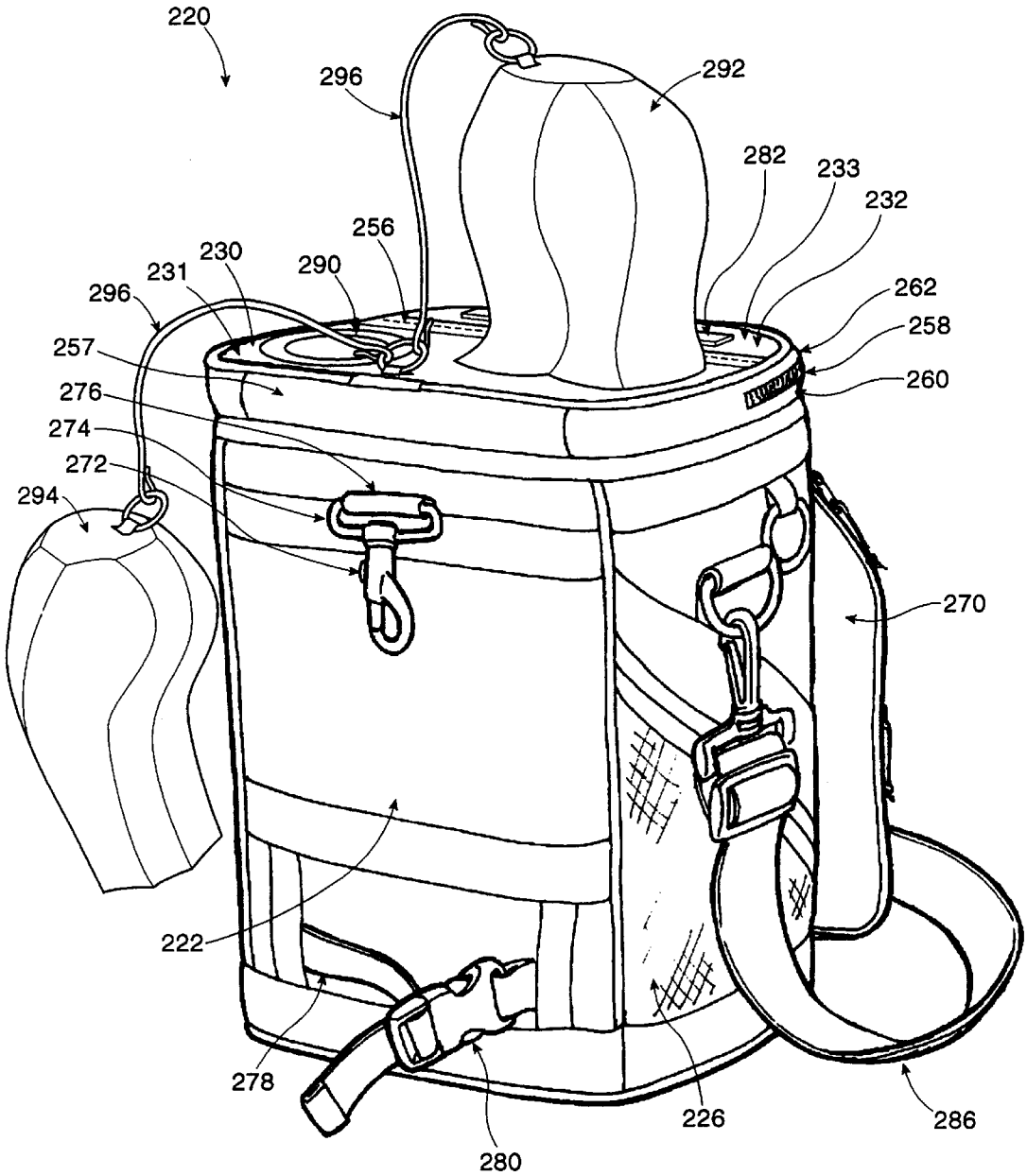
FIG. 9*a* shows a perspective view taken from above, infront, and to the left hand side of an example of an insulated soft-sided container according to the principles of the present invention, having a form similar to a golf bag and receptacle covers.
Figure 9B:
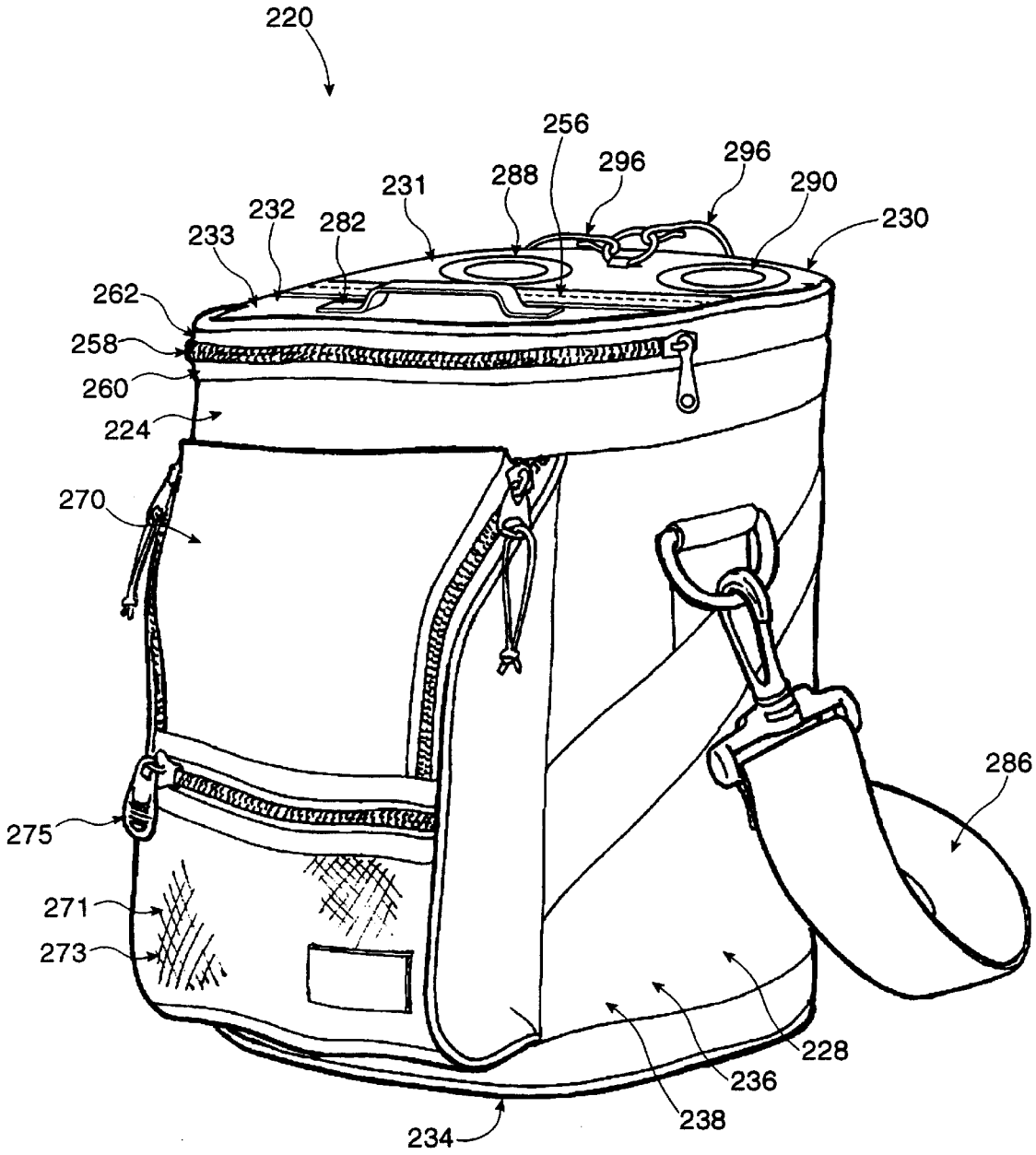
FIG. 9*b* shows a perspective view of the container of FIG. 9*a* from above, behind, and to the rear, with receptacle covers removed.
Figure 9C:
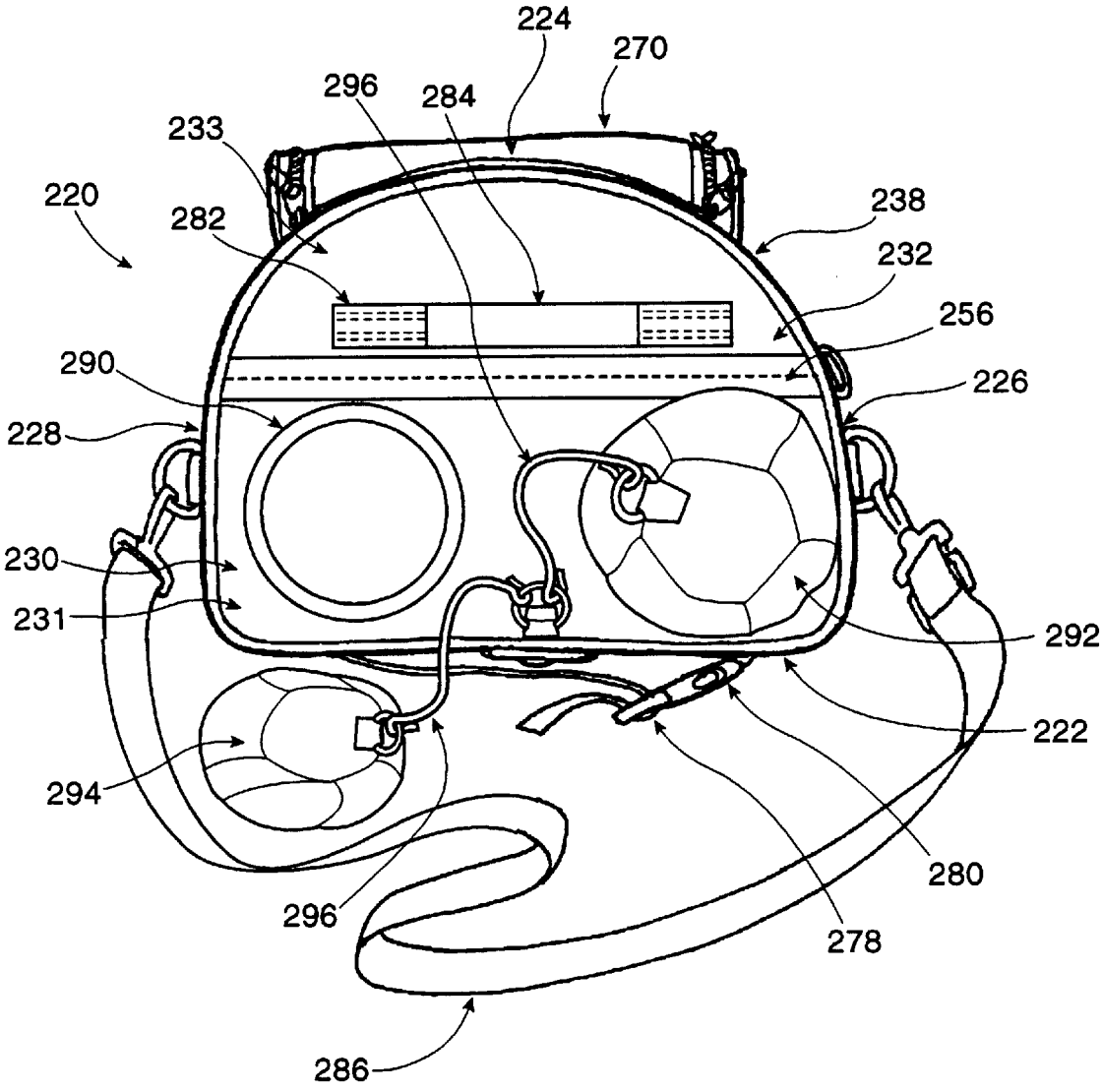
FIG. 9*c* shows the container of FIG. 9*a* from above.
Figure 9D:
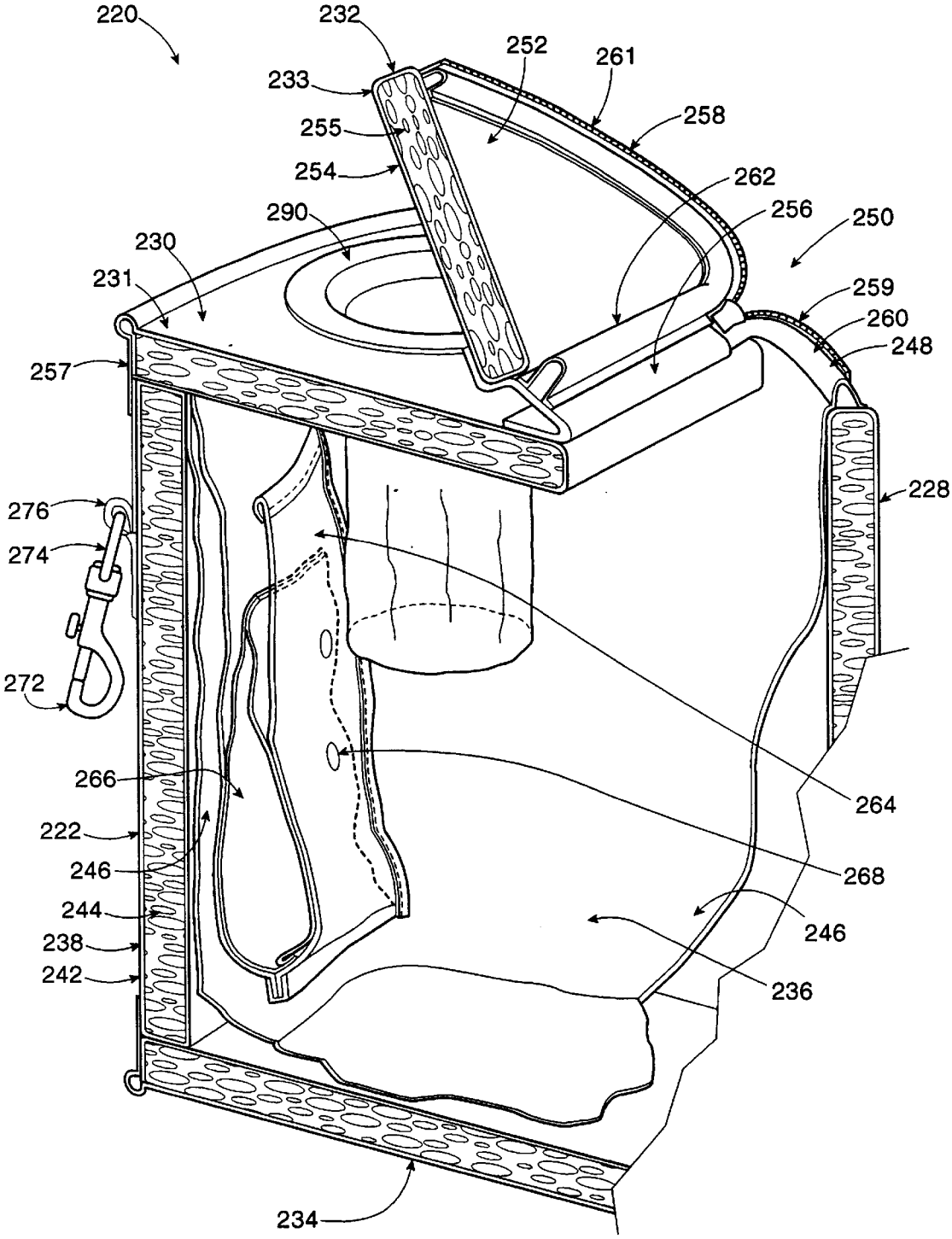
FIG. 9*d* is a scab section of the container of FIG. 9*a*, showing the construction thereof.

Referring to FIGS. 9*a*, 9*b*, 9*c* and 9*d*, an insulated pack having a shape that is generally similar to a golf bag, but on a smaller scale, is shown generally as 220. It has a leading portion 222, a trailing portion 224, a pair of left and right hand side portions 226 and 228, a top portion 230 having a lid 232, and a bottom portion 234. The major part of pack 220 is an insulated compartment 236 bounded by a modestly flexible soft shell insulating wall, 238, whose construction is shown in FIG. 9*d*. The breadth of pack 20, that is, the overall width when viewed from the leading or trailing directions, is about 8½" empty. When undeformed, pack 220 has a gently bulging D-shaped cross section when seen from above, similar to a golf bag, although this may change somewhat when loaded. The breadth is roughly the same as the thickness of a middling to large size of golf bag. Referring briefly to the detail of FIG. 9*d*, wall 238 has an outer covering 242 of webbed construction, and an internal closed cell foam layer 244 within a covering 242. The interior of pack 220 has a flexible, waterproof liner 246, such as may be made of a flexible vinyl sheet or other suitable material.

Liner 246 is not, in the example illustrated, fixed to the bottom of compartment 236, but can be pulled out of compartment 236 to an inverted position (while still remaining attached at rim 248) to facilitate washing with soap, and to facilitate drying, to discourage the grow of fungus and so on. Liner 246 has a single circumferential seam to join a bottom face, and a single wall seam running from the circumferential bottom seam to rim 248. In an optional alternative, liner 246 could be made from a polymer that has been impregnated with an antimicrobial compound prior to fabrication, a desirable feature for this kind of liner.

The top of compartment 236 is formed by generally D shaped lid 232. Lid 232 also has a through section structure of a flexible reflective inner layer, 252, a flexible skin in the nature of a canvas or webbing covering, 254, and a flexible closed cell insulation layer 255, (similar to layer 244, above) captured in between. Lid 232 is joined to the main body of pack 220, along the roughly straight side of the 'D' shape, at a juncture indicated as 257. Lid 232 is divided into fore and aft portions 231 and 233 by a transversely extending medial hinge in the nature of a flexible fabric hinge 256. Rearward portion 233 of lid 231 is bounded along its relatively straight side by flexible hinge 256, and along its arcuate side by a peripheral tracked closure in the nature of a zipper 258 by which it is joined to the upper edge of trailing portion 224. When rearward portion 233 is moved to an open position, as shown in FIG. 9*d* (as opposed to the closed position shown in FIGS. 9*a*, 9*b*, and 9*c*) it provides access to compartment 236 through an opening indicated generally as 250.

Rim 248 has a spongy beaded lip 260 wrapped within the upper edge of liner 246, adjacent to the set of zipper teeth 259 of zipper 258 that is mounted to the main body of pack 222. Lid 232 has a mating generally arcuate lip 262 adjacent to the set of zipper teeth 261 of zipper 258 mounted to lid 232. When zipper 258 is closed, lip 262 is drawn down to bear on the outside surface of beaded lip 260, encouraging a sealing contact to be formed.

Within main compartment 236 a thermal transfer storage medium compartment is provided by the use of a sack 264 for holding the thermal storage medium 266. Thermal storage medium 266 may be used as a source of heat to be transferred into the contents of compartment 236, that is, to maintain a warm temperature distribution in compartment 236. Alternatively, the thermal storage medium 266 can be used as a heat sink to maintain a cool, chilled, or freezing temperature distribution in the contents of compartment 236, as circumstances may require. Sack 264 has an array of perforations 268 to allow air to circulate through sack 264 more easily, facilitating drying of sack 264 after washing.

Insulated pack 220 also has an auxiliary compartment in the nature of a valuables compartment 270, mounted to trailing portion 224, externally of soft shelled insulating wall 238. Cover 242 is made of a 600 denier polyester fabric, treated, as are all external surfaces of pack 220, to be stain and water resistant. Other wall fabrics can be used, such as leather or leather-like vinyl.

A vented, see-through pocket 271 is mounted externally to trailing portion 224, and is of a size for accommodating, for example, extra golf balls, gum, candy bars or other items. The open form mesh 273 permits objects in pocket 271 to dry more easily. Pocket 271 is closed by a sliding closure in the form of zipper 275.

A main attachment, suitable, for example, for hanging pack 220 from a golf bag, or for clipping pack 220 to a golf bag or golf cart, is shown as a quick release brass hook fitting 272 is mounted to an upper region of pack 220 on leading portion 222. Hook fitting 272 is free to revolve within its hinge fitting, 274, which itself is able to swing up and down within the confines of a broad loop of webbing 276.

A second attachment, suitable for tightening to another fastening location of a golf bag or golf cart, in the nature of an adjustable cinch strap 278 is mounted to a lower region of pack 220, also on leading portion 222. Strap 278 has a releasable catch 280, and can be used to tighten the lower region of pack 220 to a golf bag, golf cart, or other object, to restrain its swaying motion about the main attachment at hook fitting 272. It is anticipated that a significant use of main insulated compartment 236 will be for carrying cans of liquid, such as carbonated beverages, fruit drinks, or beer, whether or not accompanied by ice cubes or crushed ice. The embodiment illustrated has a capacity of 12 cans of 385 ml plus ice, in FIGS. 9*a*, 9*b* and 9*c*. The main attachment at hook fitting 272 is able to carry the entire weight of pack 220, and the second attachment, at cinch strap 278, inhibits swaying of pack 220 about the first attachment. Fitting 272 and strap 278 co-operate to provide a means for orienting pack 220, and thus for orienting receptacles 288 and 290, described below.

For ease and comfort of carrying pack 220 by hand, lid 232 is provided with a carrying handle 282 having a padded bail 284. Alternatively, pack 220 can be carried by a shoulder strap 286 fastened by spring clips to D-shaped rings, mounted on either of sides 226 and 228.

A pair of receptacles 288 and 290, generally similar to receptacles 54 and 56, are set in leading portion 231 of lid 232, that is to say, receptacles 288 and 290 lie forward of hinge 256. As such, access to compartment 236 by opening trailing portion 233 does not require that leading portion 231 be folded forward. Thus, items can be placed in, or removed from compartment 236 while another object, or objects, occupies one or both of receptacles 288 and 290. Removable insulated covers 292 and 294, having a general appearance similar to the appearance of coverings for driving golf clubs, such as woods, are provided for covering that portion of a beverage container, such as a beer can that would stand proud of lid 232 when seated in either of receptacles 288 or 290. Coverings 292 and 294 are restrained from being separated from pack 220 by retainers in the nature of lanyards 296, rather in the manner of golf club covers generally. Covers 292 and 294 may be held in place merely by their fit on a beer or other can, such as can 50, or, alternatively, fastening strips, such as hook-any-eye fabric fastening strips, or other suitable means, such as snaps, zippers or similar devices, may be provided for more positive engagement with lid 232 in particular, and pack 220 in general. Covers 292 and 294 encourage the maintenance of the contents of can 50 at a cooler (or, as may be desired, warmer) temperature than might otherwise be the case if can 50 were exposed to the sun or to the wind directly. Covers 292 and 294 also serve to discourage or contain spillage from open beverage containers lodges in either of receptacles 288 or 290.

Lid 232 could, as with top panel 104, be formed in a single panel to accommodate receptacles 288 and 290. Insulated covers 292 and 294 need not be in the form of golf club covers, but could be in any suitable form for providing temporary external cover for items in receptacles 288 and 290.

Figure 10:
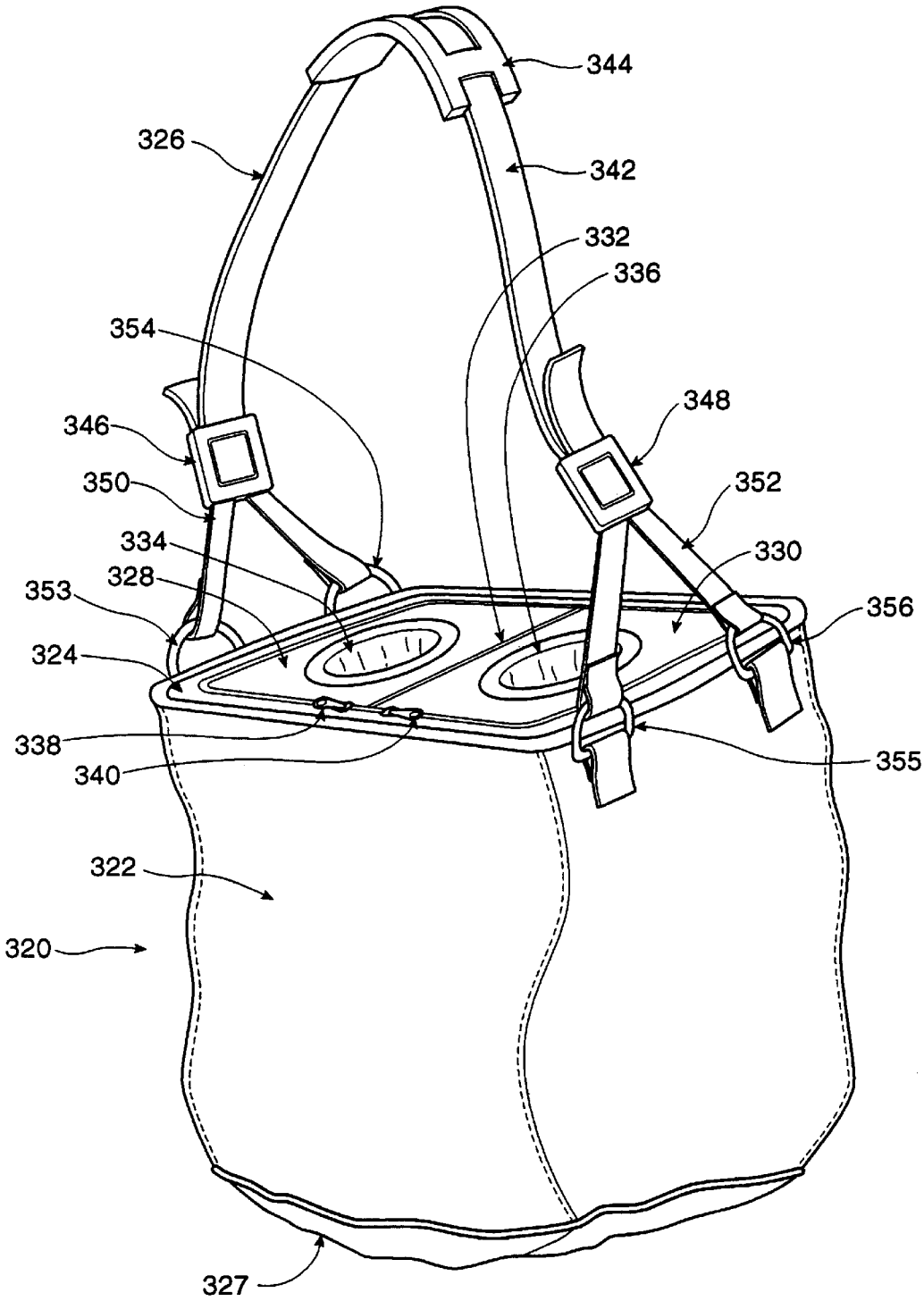
FIG. 10 shows an example of an alternative embodiment of an insulated, soft-sided container to that of FIG. 1 in the form of a bag to be carried by a strap.

In FIG. 10, an insulated container is shown in the form of a bag 320 having a flexible walled sack 322, a receptacle holding panel in the nature of a relatively stiff top panel 324, and a carrying strap assembly 326. Panel 324, as illustrated, is an insulated sandwich having an external webbing layer overlying an external vinyl skin, an internal vinyl skin, and a foam core between the two vinyl skins. Panel 324 could also be replaced by a hard-shell panel, whether made of a substantially rigid polymer, or a metal.

The relatively thick walled insulated panels of, for example, case 20 and container 100, while having some resiliency, tend to retain a generally rectangular shape, and are of sufficient stiffness that case 20 and container 100 will stand upright of their own accord without need for additional internal or external structure. By contrast, sack 322 is a relatively thin walled, watertight fabric or webbing membrane sewn (or, alternatively bonded) together in the general form of a pouch. That is, sack 322 is relatively amorphous, and lacks the stiffness to stand upright under its own weight. It is, in that sense, a "bag" as opposed to a casing. The lower extremities of sack 322 may have an extra thickness, typically of a wear resistant facing material 327 suitable for resting on the ground. Sack 322 has a leak resistant, vinyl liner (not shown) similar to the vinyl liner 246 of pack 220 described above.

Top panel 324 is of similar construction to top panel 24 of case 20, and is sufficiently stiff to accept the installation of a pair of hinged doors 328 and 330, sharing a common medial flexible hinge 332. In the midst of each of doors 328 and 330 is a receptacle 334 or 336, respectively, of the same general construction as receptacle 54 or 56. Each of doors 328 and 330 has a closure member, in the nature of a zipper 338 or 340 extending around the remaining three sides of the respective doors, by which access to the interior enclosed space of bag 320 is obtained.

Strap assembly 326 has a shoulder band 342 with a shoulder pad 344. Each end of band 342 is secured to a buckle or clasp 346 or 348. A pair of spreader straps 350, 352 are fed through clasps 346 and 348 and secured at support rings 353, 354, 355, and 356 mounted about the top edge of sack 322 to discourage, or reduce, tipping of top panel 324 when bag 320 is hanging from strap assembly 326.

In the assembly illustrated in FIG. 10, a beverage can repose in one of receptacles, receptacle 334 for example, while access is obtained to the interior of sack 322 by opening the other door, such as door 330. As with the other types of containers described herein, bag 320 can be used to encourage objects to remain either heated or cooled relative to their surrounding ambient environment, and may contain heating or cooling sources, such as heating pads or cooling packs for that purpose. The capacity of bag 320 is such that it can accommodate more objects in addition to the inwardly extending portions of receptacles 334 and 336. As noted above, the inwardly extending portions of receptacles 334 and 336 can be made of a variety of materials to permit them to collapse or deflect when not in use, and can have rectangular, round, hexagonal, octagonal or other shaped cross-sections. Receptacles 334 and 336 could also have covers if desired, whether similar to cover assembly 164 of container 100, or of upstanding covers for shading, or sheltering, an object seated in the receptacle, such as covers 292 or 294 of container 220, whether in the shape of golf club covers or some other shape. Similarly, bag assemblies having only a single receptacle, or more than two receptacles are possible, as are bag assemblies having a receptacle in a non-opening portion of a top panel, with opening portions of a top panel that do not have receptacles mounted therein. Various combinations of these features are possible.

Figure 11A:
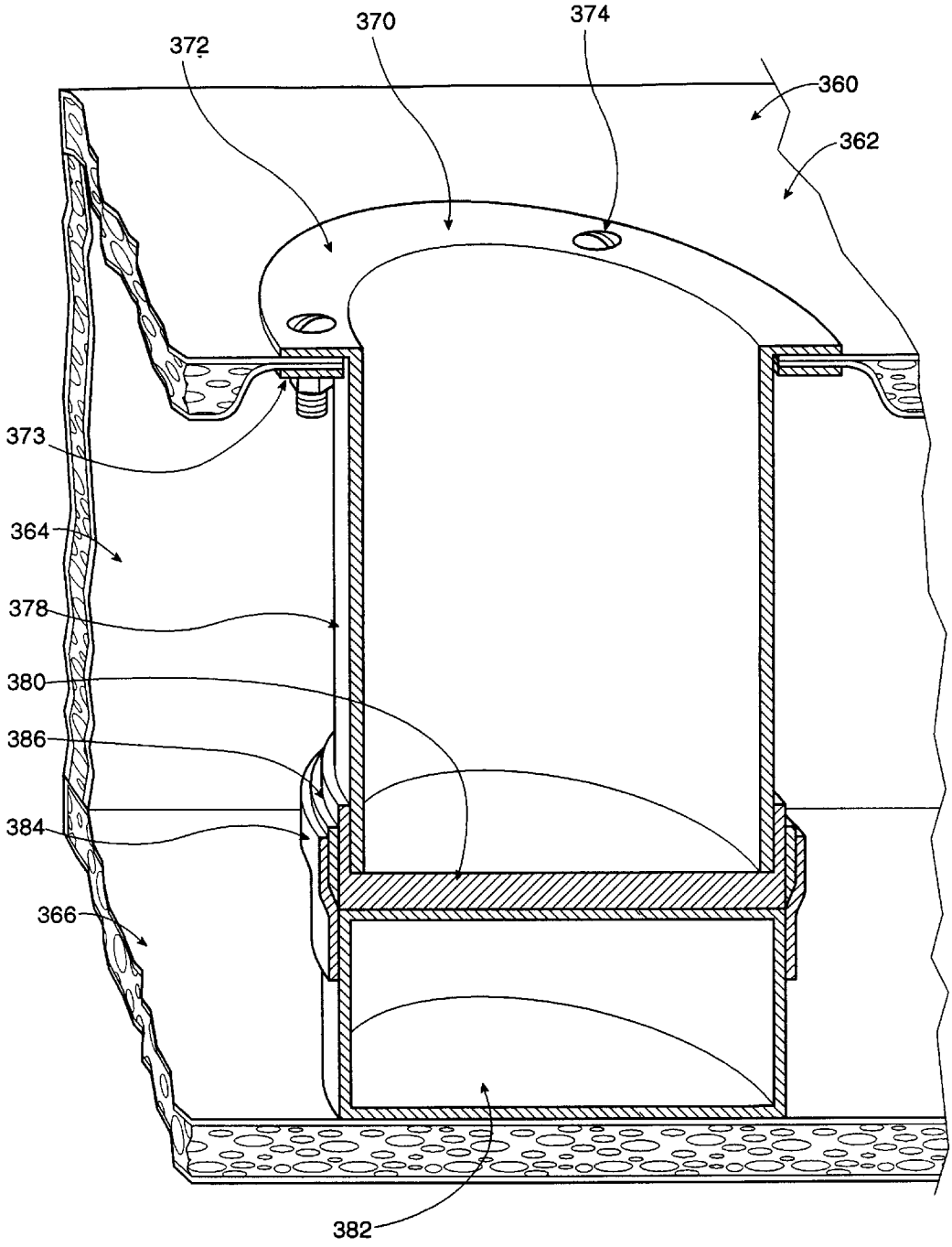
FIG. 11*a* is a scab section of an alternative example of a container similar to the container of FIG. 4*a*, having a receptacle having a thermal source element.

A partial section is shown in FIG. 11*a* of an insulated container 360 having a top panel 362, a sidewall panel 364, and a bottom panel 366 all of generally similar watertight construction to that of case 20, container 100, and container 200. Container 360 could have a water tight liner similar to liner 246, although this is not shown in FIG. 11*a*. A receptacle 370 is shown having a flanged fitting 372 and co-operating annular backing plate for clamping the adjacent land of top panel 362 when fasteners 374 are tightened. (Other types of fastening arrangement could be used). A downwardly extending sidewall is indicated as 378. It terminates at a base member 380 whose upper surface forms the seat of receptacle 370 in a manner similar to that indicated above. A source of cooling in the nature of an ice-pack puck is indicated as 382. It is mounted by a releasable band 384 to a mating band 386 on base member 380. Base member 380 is made of a material of suitably high thermal conductivity to promote, or act as a medium for, heat transfer between puck 382 and, for example can 50 or bottle 52 when seated in receptacle 370.

As shown in FIG. 11*a*, puck 382 rests on bottom panel 366. Alternatively, a sidewall having less depth than sidewall 378 could be employed, such that puck 382 would be suspended at some intermediate height above bottom panel 366. Further still, if combined with a cover such as shown in FIG. 7*a*, when receptacle 370 is not in use, puck 382 can be suspended adjacent to top panel 362. Although puck 378 is a heat sink to provide cooling within container 360, either a heat source or a heat sink can be employed, depending on the need for heating or cooling.

Figure 11B:
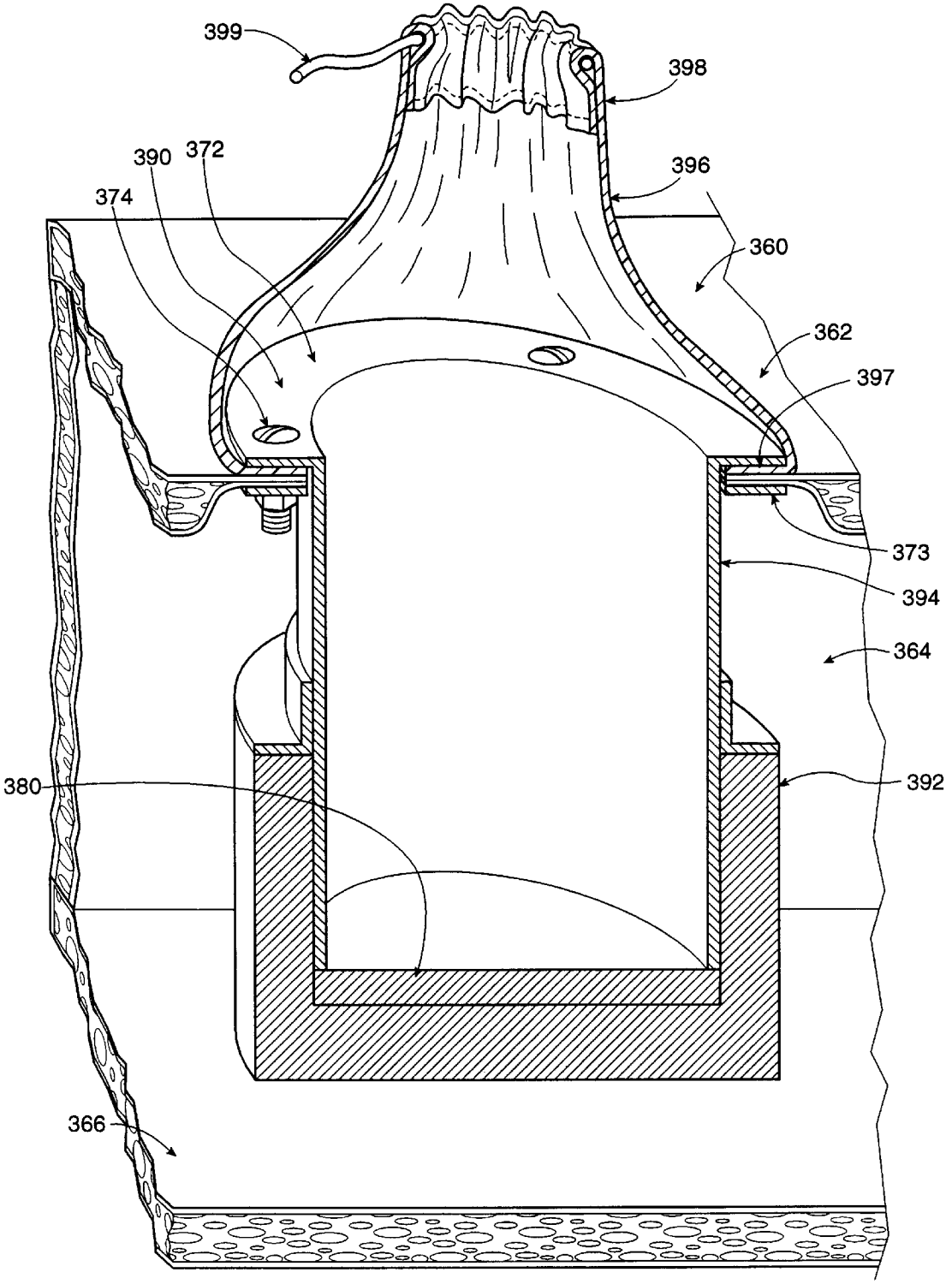
FIG. 11*b* is a scab section of an alternative to the container to that of FIG. 11*a*.

In an alternative embodiment to that shown in FIG. 11*a*, in FIG. 11*b*, the lower region of a receptacle 390 is shown engaged within an ice pack cylinder, or cup 392 which has a cylindrical portion that extends upwardly to provide cooling to downwardly depending circumferential wall 394. Such an ice pack can be formed in a cylinder with a base, as shown in FIG. 11*b*, or in a cylindrical tube open at both ends, or as a cylinder having a taper, whether open ended or not. Base member 380 could have a fastening member to snap to a cover as shown in FIG. 7*b*.

Although no cover is shown in FIG. 11*a*, a covering could be provided, for example, similar to that shown in either FIGS. 7*a* and 7*b*, or in FIG. 9*a*. As an alternative type of cover, in FIG. 11*b*, a covering is shown in the nature of a skirt, or boot, or shroud 396. The periphery of the lowermost extremity, indicated as hem or cuff 397 is captured under flanged fitting 372. The periphery of the uppermost edge, being a neck or waist, and indicated as collar 398 is folded over to accommodate a drawstring 399, by which waist 398 can be drawn tight to gather, as shown, typically about the circumference of a can, or about the neck of a bottle, or, if tall enough, above the top of the can or bottle.

Figure 12A:
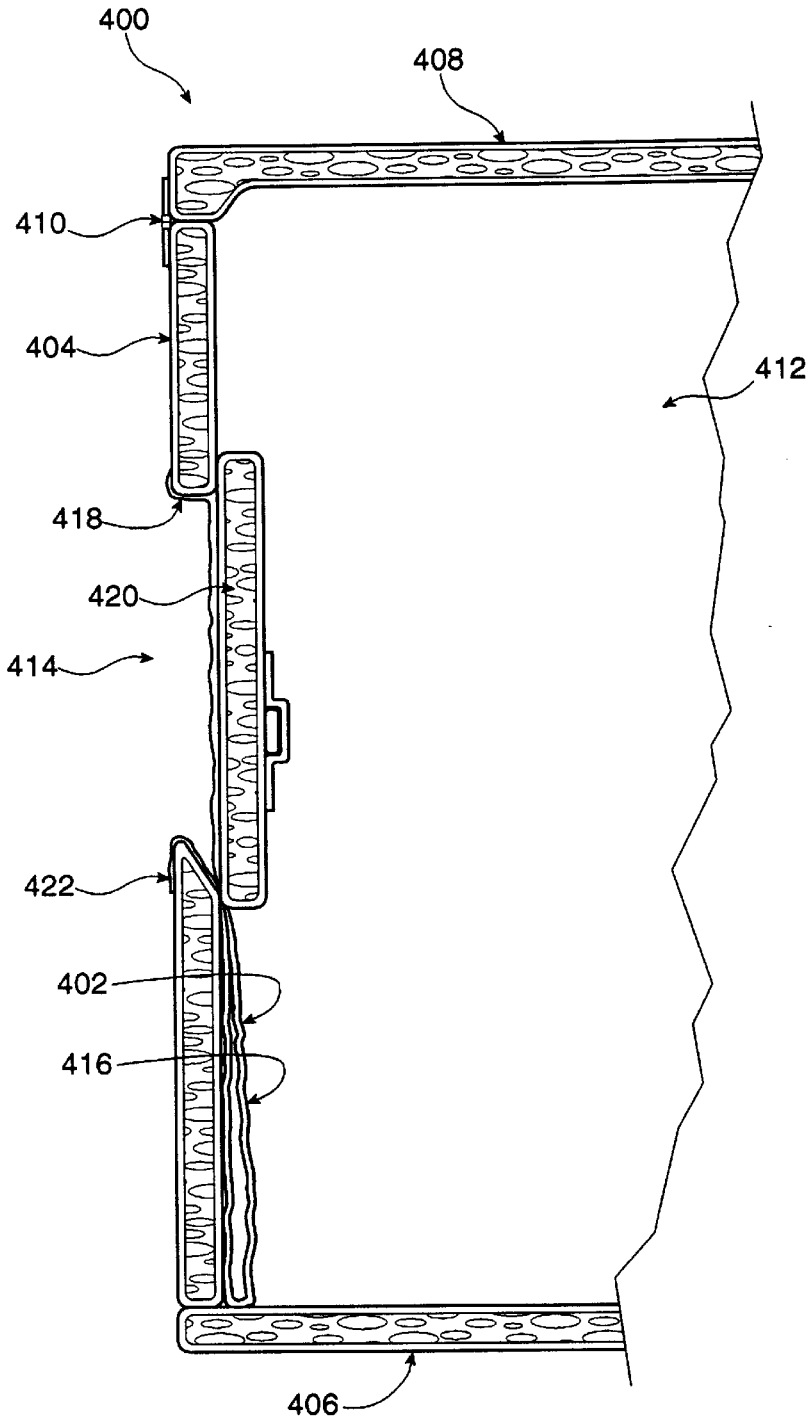
FIG. 12*a* shows a cross-sectional view of an alternative example of an embodiment of an insulated container according to the present invention having a receptacle mounted to a side-wall thereof, in a closed position.
Figure 12B:
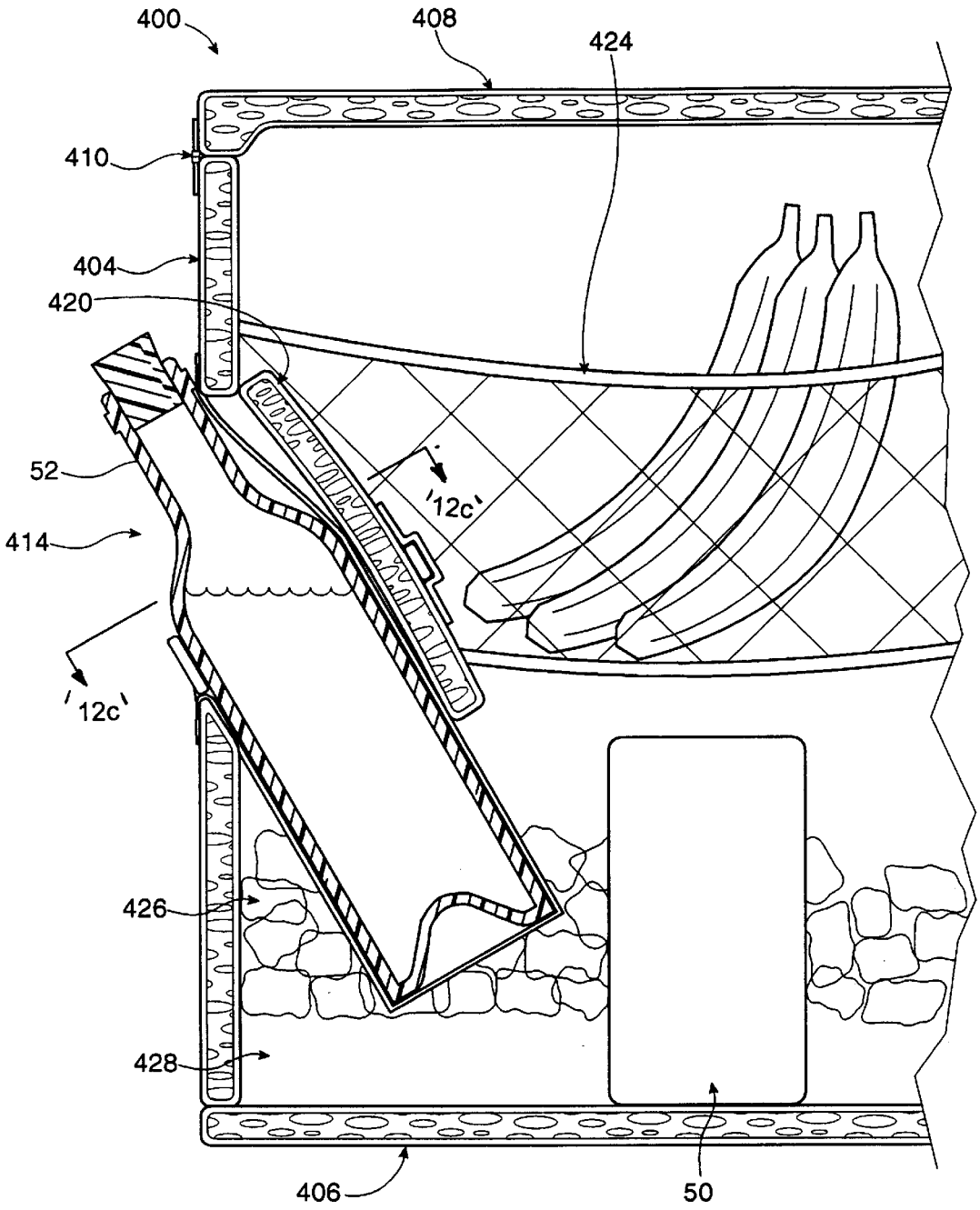
FIG. 12*b* shows a cross-sectional view of the container of FIG. 12*a*, the receptacle being in an open condition.

FIGS. 12*a* and 12*b* show a partial section of a soft sided container 400, generally similar to container 200 described above. Container 400 differs from container 200 insofar as it has a suspended receptacle 402 mounted in an insulated sidewall panel 404. A bottom panel is shown as 406, and a top panel is shown as 408. Top panel 408 is connected to sidewall panel 404 by a tracked closure member in the nature of a zipper 410. Thus top panel 408 is openable to give access to the internal enclosure space 412 of container 400.

Figure 12C:
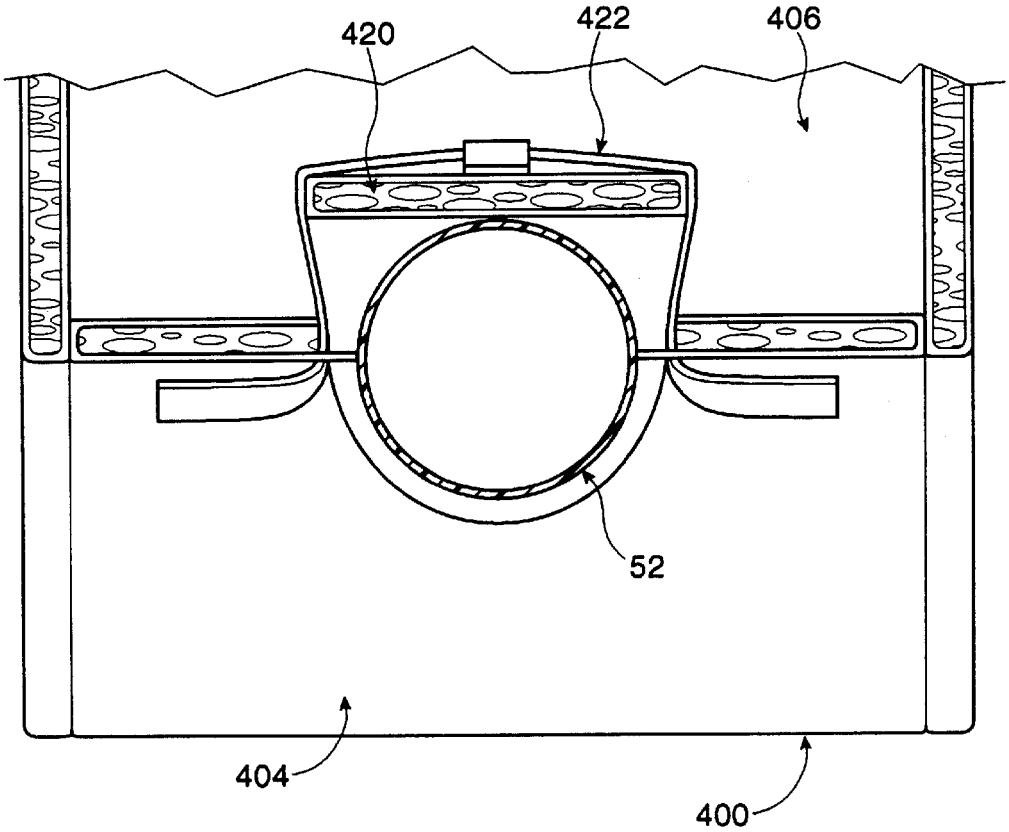
FIG. 12*c* shows a partially cross-sectional view of the container of FIG. 12*b* taken on section "12*c*–12*c*".

An opening 414 is defined in sidewall panel 404, and a collapsible sidewall member in the nature of a water-tight nylon (T.M.) web 416 is mounted about lip 418 of opening 414. A closure member in the nature of a hinged flap, or door 420, is mounted on a fabric hinge to the inside of sidewall panel 404, and is moveable from a closed position as shown in FIG. 12*a* for discouraging heat transfer through opening 414, to an open position as shown in FIG. 12*b* for permitting an object, such as bottle 52, to be introduced through opening 414 to seat in receptacle 402. Notably, a portion of bottle 52, namely its neck, protrudes through opening 414 to facilitate removal from receptacle 402 from time to time as may be desired. As illustrated in FIG. 4*a*, when receptacle 402 is not in use, web 416 can hang, collapsed, unobtrusively within the enclosed space of container 400, typically adjacent a lower portion of sidewall panel 404. The return of door 420 to its closed position, as shown in FIG. 4*a*, is encouraged by a biasing member in the nature of an elasticized band 422 shown in FIG. 12*c*. Band 422 is mounted to the external face of sidewall 404, extends about the exterior of web 416, and along the inwardmost face of door 420. Other types of biasing members, such as a spring could be used, or door 420 could move to its closed position under gravity alone.

The enclosed space of container 400 can also accommodate other objects than those that may seat within receptacle 402, as illustrated by a number of bananas in a mesh pouch 424, or can 50 set about with ice-cubes 426, shown floating in meltwater 428. As shown in FIG. 12*b*, bottle 52 hangs in such a manner as to cause its neck to engage the uppermost portion of the periphery of the lip of receptacle 402, limiting the angle at which bottle 52 can hang.

Figure 13A:
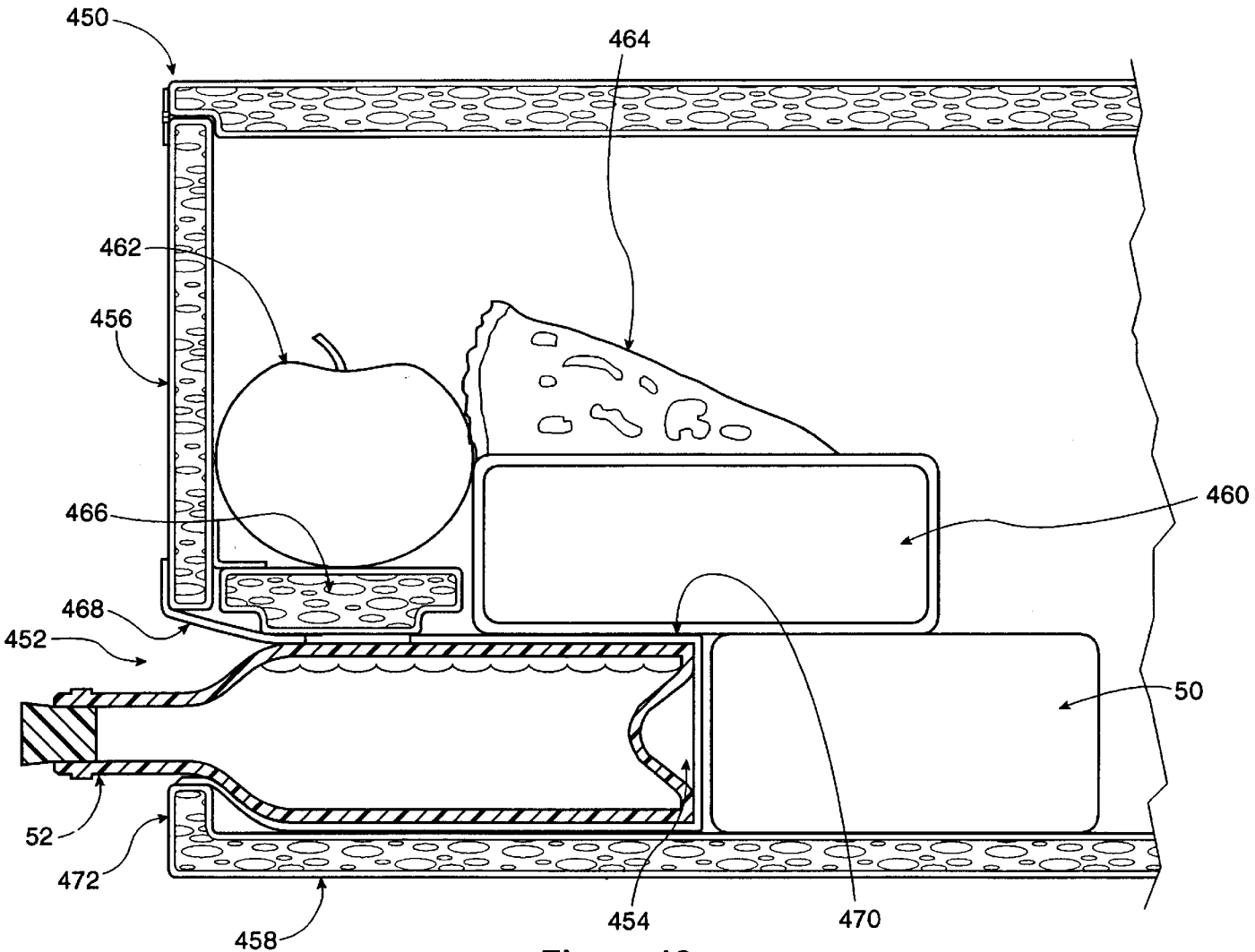
FIG. 13*a* shows a partial cross-sectional view of an alternative example of an embodiment of an insulated container according to the present invention having a receptacle mounted in a sidewall and adjacent to a bottom wall thereof, in an occupied condition.
Figure 13B:
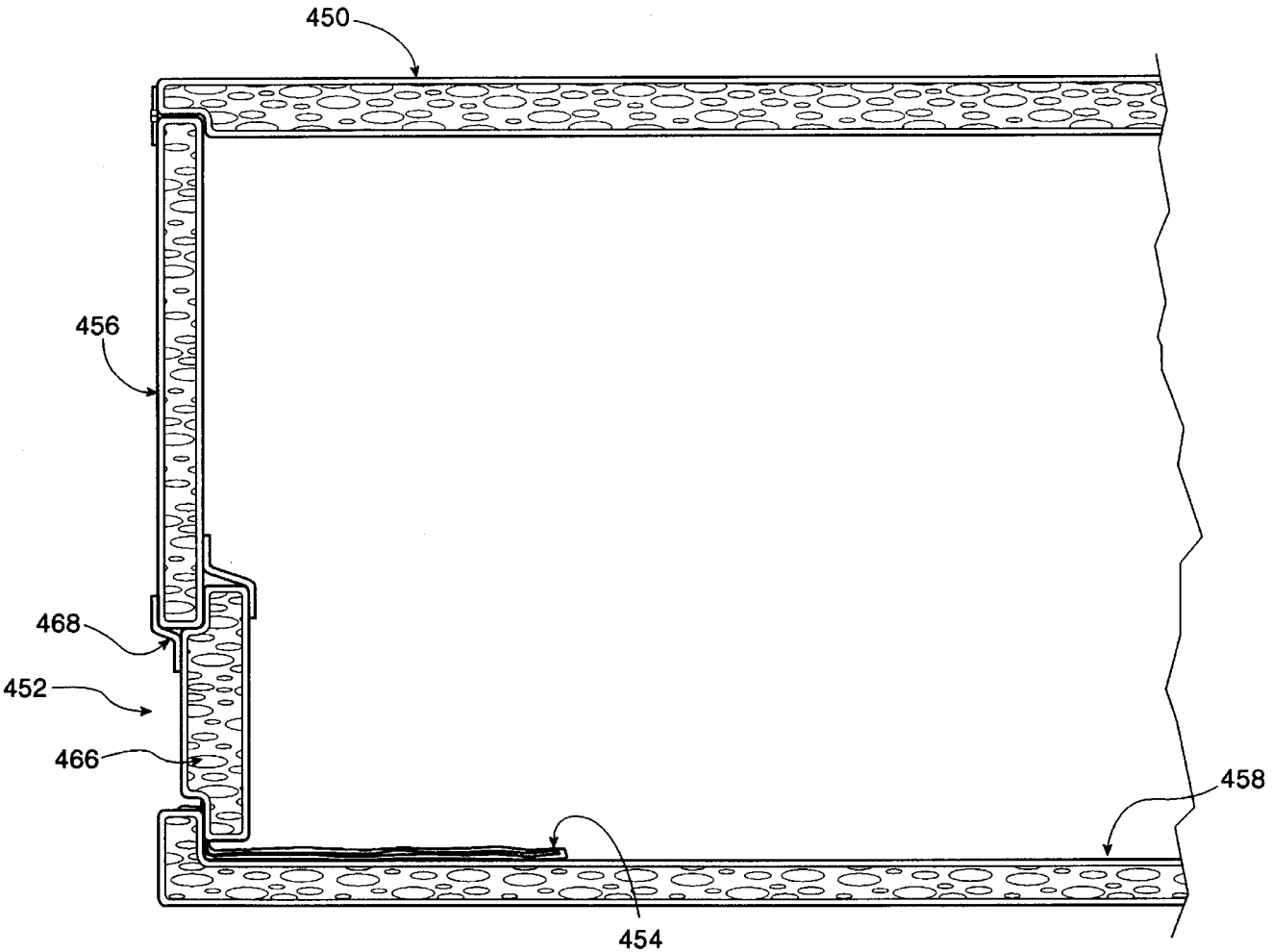
FIG. 13*b* shows a partial cross-sectional view of the container of FIG. 13*a* with the receptacle thereof in a closed position.

A container similar to container 400 is indicated generally as 450 in FIGS. 13*a* and 13*b*. In this instance opening 452 and water tight receptacle 454 are similar to opening 414 and receptacle 402, but are located in sidewall panel 456 adjacent to bottom panel 458 to permit bottle 52 to be placed in a position lying on bottom panel 458. Other objects, such as can 50, can also be placed in the enclosed space of container 450, and a cooling or heating medium, such as ice pack 460, can be placed about, or as shown, on top of bottle 52 and can 50. Other items such as fruit and cheese 462 and 464 are also shown. In FIG. 13*b*, door 466 of receptacle 454 is shown urged to its closed position by a biasing member in the nature of an elasticised hinge 468. Watertight sidewall 470 of receptacle 454 lies upon bottom panel 458 when not in use. Sidewall panel 456 has a shoulder 472 that acts as a retainer for discouraging bottle 52 from leaving receptacle 454 unexpectedly. Bottle 52 can be drawn outwardly past shoulder 472 when required, but is intended to be a relatively tight fit.

A stiff seat member could be placed at the depending end of either receptacle 402 or 454. Such a seat member could resemble seat 186 of container 100 shown in FIG. 7*a*. In the collapsed position of FIG. 13*b*, such a seat would also tend to lie flat against bottom panel 458.

Figure 14:
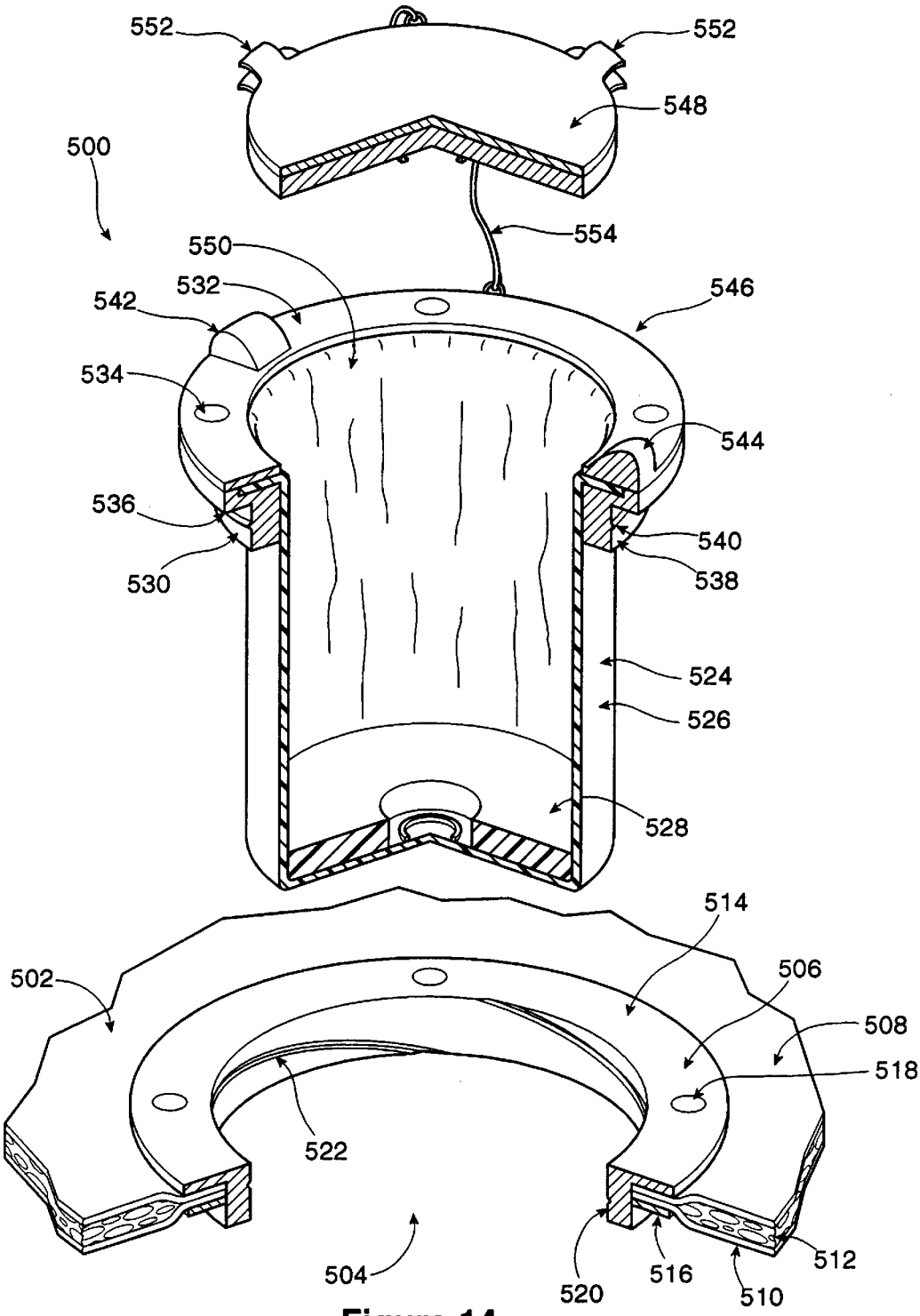
FIG. 14 shows an example of an alternative embodiment of receptacle for use in the containers of FIGS. 1, 4*a*, 8, 9*a*, 10, 11, 12*a*, or 13*a*.

A removable receptacle assembly 500 is shown in FIG. 14. It is mounted in an insulated panel 502, such as might be analogous to top panel 24 of case 20, top panel 104 of container 100, or other insulated panels in which a receptacle can be mounted. Panel 502 has an opening, generally indicated as 504. A panel fitting 506 mounts in opening 504 in a manner generally similar to the mounting of the flanged receptacle fitting described above, such that upper skin 508, lower skin 510, and insulating layer 512 are clamped between a radially outwardly extending flange 514 of fitting 506, and a backing ring 516 by fasteners 518, shown as flush countersunk plastic rivets. Fitting 506 has a downwardly extending circular cylindrical wall 520 having a female thread 522.

Receptacle assembly 500 also has a well 524 having a water-tight well sidewall 526 and a seat 528 for location in the bottom of well 524. The upper edge of sidewall 526 is captured between a ring fitting 530 and an annular face plate 532, the three parts being fastened together by rivets 534. Ring fitting 530 has a radially outwardly extending shoulder 536 for abutting the upward face of flange 514, and a downwardly extending generally cylindrical leg 538 having a male thread 540 for engaging female thread 522 of fitting 506. Face plate 532 has a pair of upwardly extending abutment members, in the nature of thumb-screw wings 542 and 544, by which a person may cause threads 522 and 540 to tighten or loosen. The receptacle 546 of receptacle assembly 500, that is to say, all of assembly 500 but fitting 506, may then be moved between an installed position in which receptacle 546 is engaged within fitting 506, and a removed position in which receptacle 546 is not engaged within fitting 506. Receptacle assembly 500 is also shown to include a cover 548 for snap fitting engagement within the opening 550 defined in face plate 532, cover 548 also having wings 552 to permit it to be removed. Cover 548 is secured to face plate 532 by a cable 554.

Removal of receptacle 546 in this way permits a damaged receptacle to be replaced or repaired, and permits a dirty receptacle to be cleaned. Other types of removable fitting could be used, including a pair of snap fit parts, or a resilient tapered abutment and stop, such as can snap into place when pushed in, and then be released by deflecting the tapered member to release the stop, a receptacle held in place by a roll pin or a cotter pin, or a snap ring; or other suitable releasable engagement means.

Figure 15:
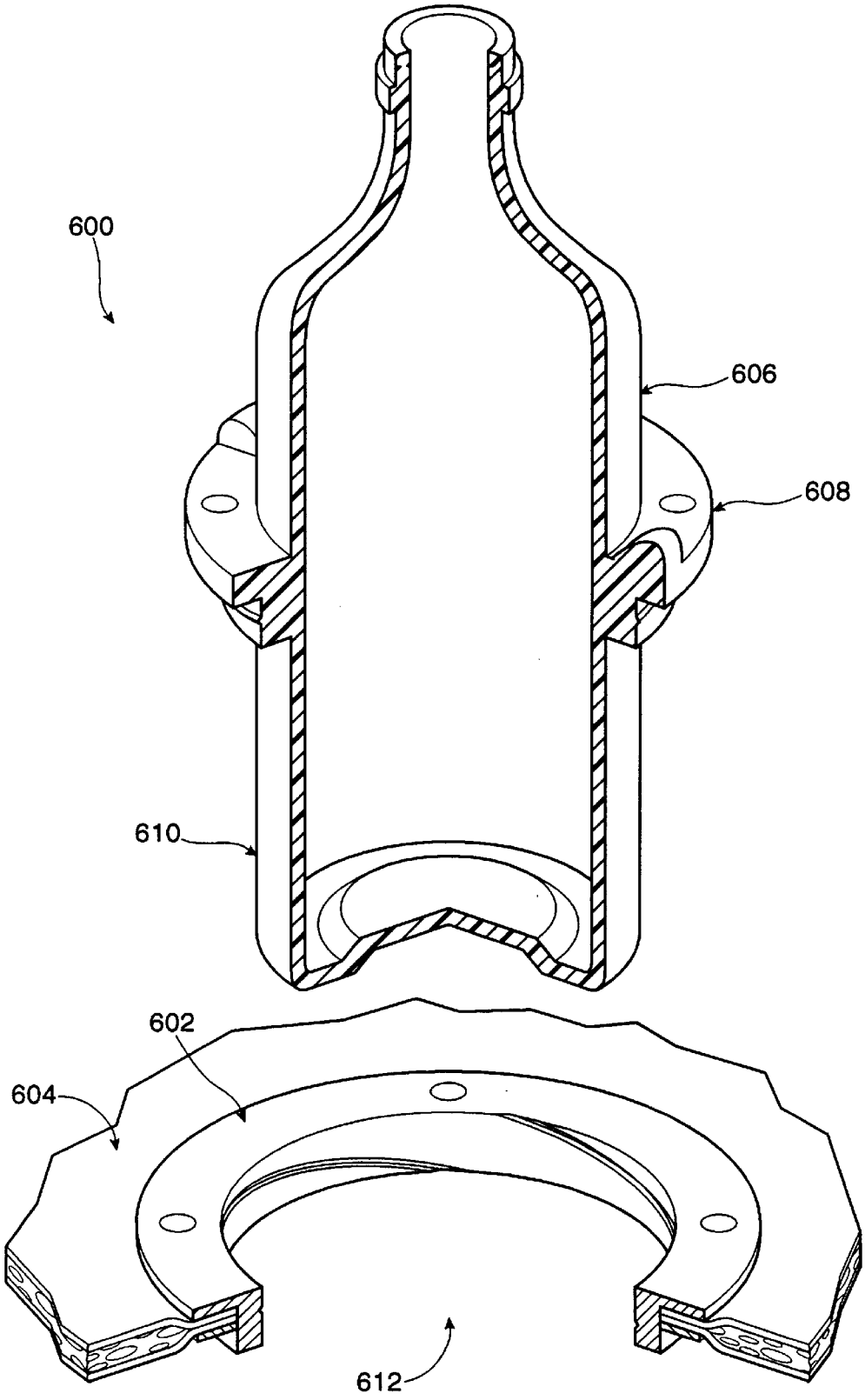
FIG. 15 shows an example of an alternative embodiment to the receptacle of FIG. 14 having of integral bottle and receptacle assembly.

In the embodiment of FIG. 15, a bottle assembly is indicated generally as 600. A fitting 602 similar to fitting 506 of receptacle assembly 500 is shown mounted in an insulated panel 604, in the manner of that shown in FIG. 14. However, rather than having a receptacle having a mating threaded ring, such as ring fitting 530, assembly 600 employs a bottle 606 having an threaded ring 608. The closed end 610 of bottle 606 can be introduced into opening 612 in panel 604 and ring 608 engages fitting 602 in the manner of fitting 506 and ring fitting 530 as described above. The neck of bottle 606 protrudes from opening 612 to facilitate removal of bottle 606 when desired. Other types of releasable engagement means could be used rather than a threaded fitting. For example, a spring-loaded detent, such as a ball or knob detent in place of the threads of fitting 602 for engaging a depression, or groove, in threaded ring 608 could be used.

Figure 16A:
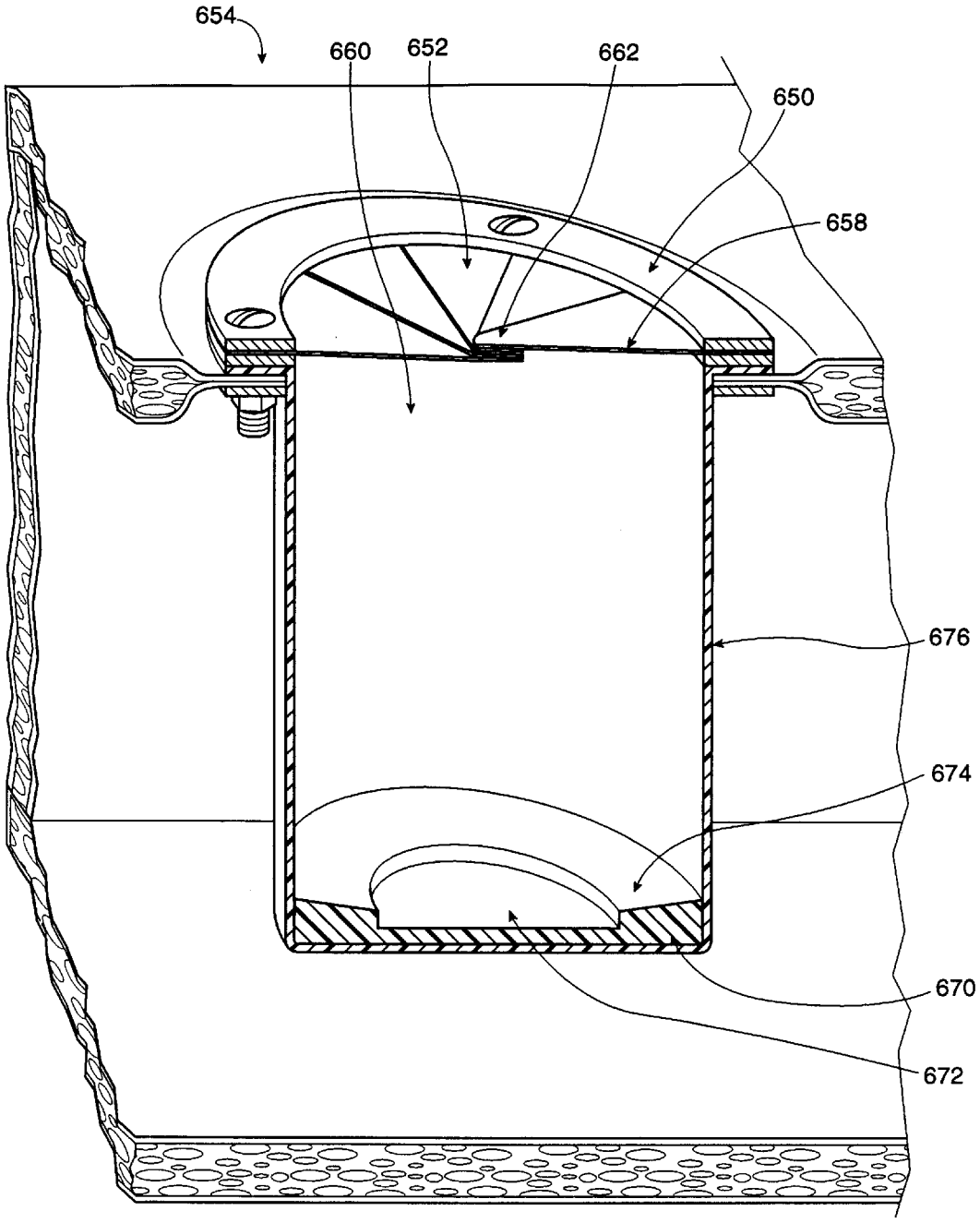
FIG. 16*a* shows an example of an alternative embodiment of a receptacle having a moveable closure.

FIG. 16*a* shows a receptacle 650 having a closure in the nature of a heat transfer barrier 652 for discouraging unwanted heat transfer to or from the enclosed space of container 654 is mounted inwardly of a fitting 656. Barrier 652 also discourages the entry of unwanted foreign objects. Barrier 652 has eight inwardly extending, generally triangular, nested, overlapping flexible, resilient fingers 658.

Figure 16B:
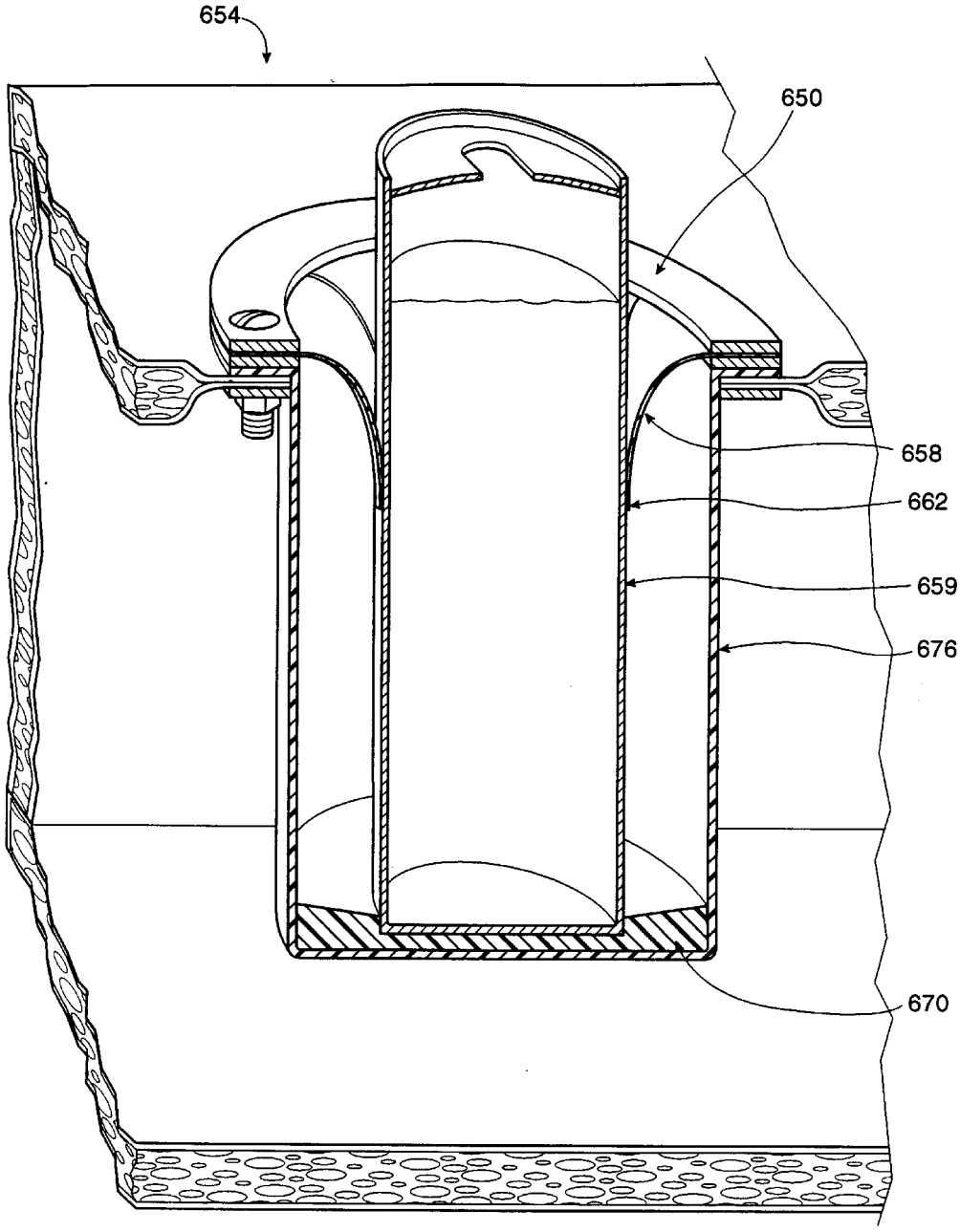
FIG. 16*b* shows the closure of FIG. 16*a* in a displaced condition.

As shown in FIG. 16*b*, when the closed end of a can 659 is introduced into opening 660, it causes tips 662 of fingers 658 to deflect downwardly and radially outwardly to accommodate the passage of bottle 52. When bottle 52 is removed, fingers 658 return to their former, closed position.

Inasmuch as fingers 658 are resilient, their springiness will tend to bias tips 662 inwardly, that is toward the centerline of receptacle 650, when deflected as shown in FIG. 16*b*. Such a barrier permits the insertion of different sized bottles or cans, or other objects. Base element 670 has a central well 672, for a narrow object, and a tapered, conical surround 674. The taper is intended to assist objects in centering themselves in well portion 676 of receptacle 650. Fingers 658 will also assist in tending to center objects such as can 659.

Figure 16C:
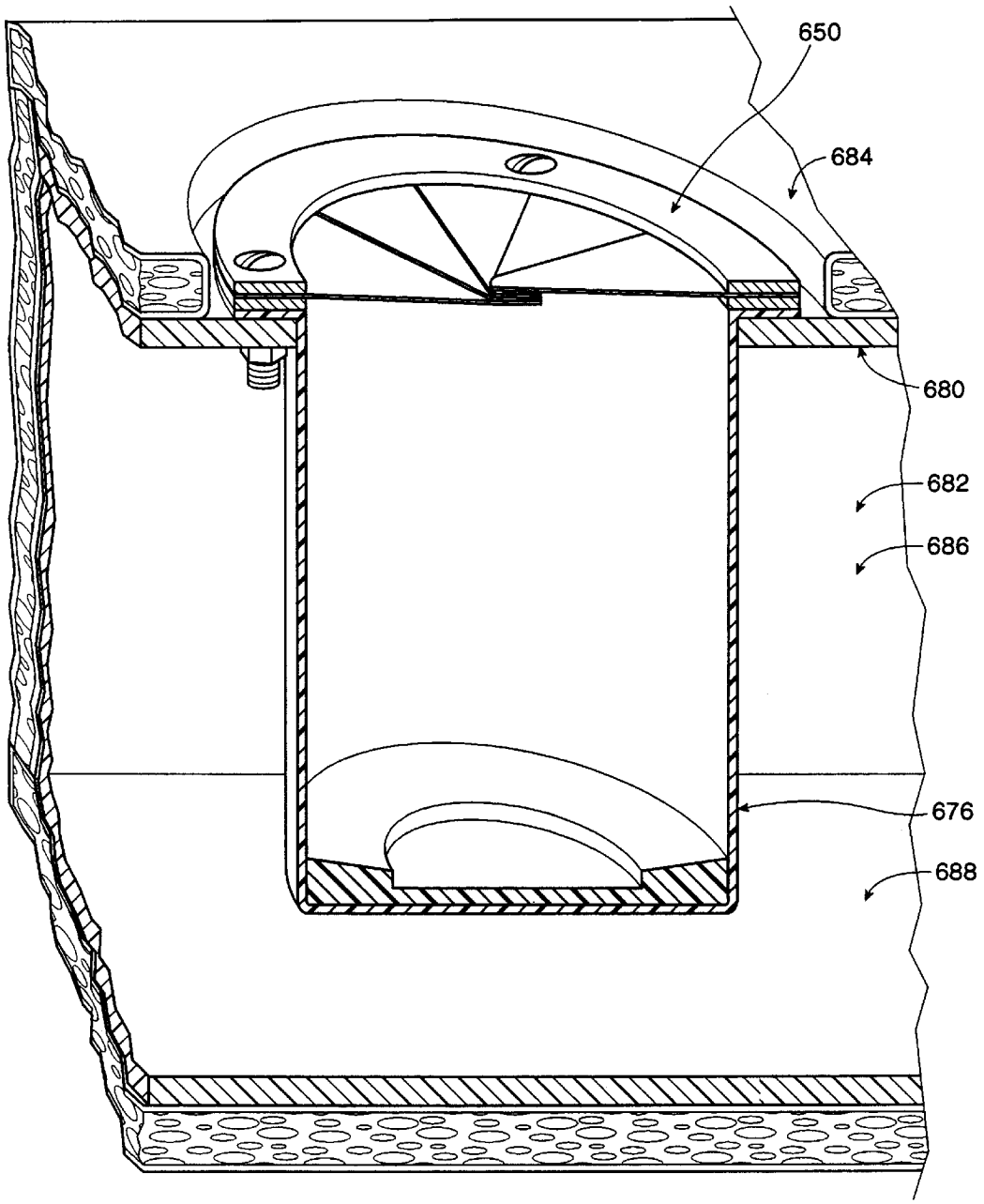
FIG. 16*c* shows the closure of FIG. 16*a* installed in a rigid panel.

FIG. 16*c* shows receptacle 650 adapted to be mounted to a hard shell panel 680 of a hard shell container 682 having external insulation 684. Although hard shell container 682 has stiff top, side and bottom panels 680, 686, and 688 respectively, not all panels need be stiff. For example, some solid, monolithic panels could be replaced by a rigid framework. In general, the receptacle assemblies described hereinabove in relation to FIGS. 1*a* to 15, could also be adapted to mounting in a hardshell panel. The hardshell panels may be fabricated from substantially rigid polymers, or from a metal such as, for example, aluminum or stainless steel.

The same kind of heat transfer barrier of a deflecting flap that uncovers an opening when moved, or several overlapping deflecting flaps, fingers, or deflecting members of similar nature, could be employed, for example, in place of cover assembly 164 of container 100. Although eight fingers in 45 degree sectors are indicated, six, twelve, or some other number, or a single flap or valve, could be used. Similarly, although barrier 616 has been described in a location inwardly of the insulated panel member, it could be located somewhat outwardly of the panel, flush with the panel, or at some depth partway through the thickness of the insulated panel.

A preferred embodiment has been described in detail and a number of alternatives have been considered. As changes in or additions to the above described embodiments may be made without departing from the nature, spirit or scope of the invention, the invention is not to be limited by or to those details, but only by the appended claims.

What is claimed is:

1. An insulated container having a container wall and an insulated space defined therewithin, said container wall having an opening defined therein, and a receptacle mounted to said container wall about said opening, said receptacle being suspended therefrom to extend inwardly of said container wall into said space, said receptacle being positioned to permit an object seated therein to protrude through said opening outwardly of said container; and said receptacle having a thermal storage medium mounted thereto.

2. The container of claim 1 wherein the thermal storage medium is a cooling pack element for providing cooling.

3. The container of claim 2 wherein said receptacle has a sidewall extending from said container wall, and a distal end; and said cooling pack element is in the form of a puck mounted to said distal end of said receptacle.

4. The container of claim 3 wherein said sidewall has a base member located at said distal end for seating an object thereon, and said puck is releasably mounted to said base member.

5. The container of claim 4 wherein said receptacle has a releasable band located about said base member for attaching said puck to said base member; said puck having a peripheral edge; a portion of said band being operable to engage said peripheral edge of said puck.

6. The container of claim 4 wherein said base member is made of a thermally conductive material to encourage heat transfer between said puck and said object.

7. The container of claim 2 wherein said receptacle has a sidewall extending inwardly, relative to said space, from said wall of said container, and said cooling pack element extends about at least a portion of said sidewall.

8. The container of claim 2 wherein:

said receptacle has a sidewall extending from said wall of said container; and said cooling pack element is in the form of a hollow cylinder and at least a portion of said sidewall is contained within said cylinder.

9. The container of claim 8 wherein said cylinder has a base at one end and at least a portion of said sidewall abuts said base.

10. The container of claim 1 wherein said receptacle has a cylindrical sidewall extending inwardly of said wall of said container, and said sidewall is formed from a pliable membrane.

11. The container of claim 1 wherein said receptacle has a means for urging objects introduced into said receptacle to a centered position.

12. The insulated container of claim 11 wherein said receptacle has a cylindrical sidewall extending inwardly of said wall of said container, and said means includes a resilient member mounted in a position to intercept objects as they are introduced into said receptacle, and said resilient member is positioned to exert a radially centering force on said objects.

13. The container of claim 11 wherein said container includes at least three resilient fingers mounted to obstruct objects introduced into said receptacle; each of said fingers is movable to a deflected position by an object introduced into said receptacle, and, in said deflected position, each of said fingers exerts a radially inward force on the object to urge it to a radially centered position relative to said cylindrical sidewall.

14. The container of claim 1 wherein said container has a sheltering member mounted to extend externally of said opening to shelter an object protruding from said receptacle through said opening.

15. The container of claim 14 wherein said sheltering member is a shroud mounted to said container and moveable to a position overlying the opening.

16. An insulated container having a container wall and an insulated space defined therewithin; said container wall having an opening defined therein, and a receptacle mounted to extend inwardly of said container wall into said space; said receptacle being positioned to permit an object seated therein to protrude through said opening outwardly of said container; said receptacle having a thermal storage medium mounted thereto; said receptacle having a sidewall extending from said wall of said container, and a distal end; said sidewall having a base member located at said distal end for seating an object thereon; said thermal storage medium being a cooling pack element for providing cooling; said cooling pack element being in the form of a puck releasably mounted to said base member.

17. The container of claim 16 wherein said receptacle has a releasable band located about said base member for attaching said puck to said base member; said puck having a peripheral edge; a portion of said band being operable to engage said peripheral edge of said puck.

18. The container of claim 16 wherein said base member is made of thermally conductive material to encourage heat transfer between said puck and said object.

* * * * *